US010857452B2

(12) United States Patent
Hodek et al.

(10) Patent No.: US 10,857,452 B2
(45) Date of Patent: Dec. 8, 2020

(54) MODULAR BALL TRACK SYSTEM

(71) Applicant: Ravensburger Verlag GmbH, Ravensburg (DE)

(72) Inventors: Johannes Hodek, Kressbronn (DE); Ralph Muenzer, Friedrichshafen (DE); Clemens Tuerck, Ravensburg (DE)

(73) Assignee: Ravensburger Verlag GmbH, Ravensburg (DE)

( * ) Notice: Subject to any disclaimer, the term of this patent is extended or adjusted under 35 U.S.C. 154(b) by 0 days.

(21) Appl. No.: 16/481,230

(22) PCT Filed: Jan. 27, 2017

(86) PCT No.: PCT/EP2017/051820
§ 371 (c)(1),
(2) Date: Jul. 26, 2019

(87) PCT Pub. No.: WO2018/137776
PCT Pub. Date: Aug. 2, 2018

(65) Prior Publication Data

US 2020/0254329 A1 Aug. 13, 2020

(51) Int. Cl.
*A63F 7/36* (2006.01)

(52) U.S. Cl.
CPC .... *A63F 7/3622* (2013.01); *A63F 2007/3662* (2013.01)

(58) Field of Classification Search
CPC ..... A63F 7/3622; A63F 2007/3662; A63F 2007/345; A63F 2007/4081; A63F 7/28; A63H 18/00; A63H 18/02
(Continued)

(56) References Cited

U.S. PATENT DOCUMENTS 4,713,038 A 12/1987 Wichman et al.
5,312,285 A * 5/1994 Rieber ..... A63F 7/3622 273/109
(Continued)

FOREIGN PATENT DOCUMENTS

CN 205699476 U 11/2016
DE 3402726 C1 8/1985
(Continued)

OTHER PUBLICATIONS

German language International Search Report and Written Opinion, dated Oct. 11, 2017, 11 pages.
(Continued)

*Primary Examiner* — Nini F Legesse
(74) *Attorney, Agent, or Firm* — Barnes & Thornburg LLP; Jeffrey Michael

(57) ABSTRACT

The invention relates to a modular ball track system, comprising the following: a plurality of module elements (12; 12'), the exterior shape of all of which is the same regular polygon in plan view and each of which has—an upper face (14), a lower face (16) opposite the upper face, and—a number of lateral surfaces (18), said number corresponding to the number of corners of said module element, wherein each module element (12; 12') forms at least one section (20, 22) of a ball track on the upper face (14) of the module element, said section passing through a lateral surface (18) of the module element, and a plug socket (24) protrudes from each module element (12; 12') on the lower face (16) of the module element, and—a base (32) with a plurality of uniformly arranged recesses (34) for receiving a respective plug socket (24), wherein the plurality of recesses (34) are arranged on the base (32) in a grid, the size (s) of the grid corresponds to the incircle diameter of the regular polygon which forms the exterior shape of the module element, and module elements (12; 12') plugged into directly adjacently
(Continued)

Figure 1:
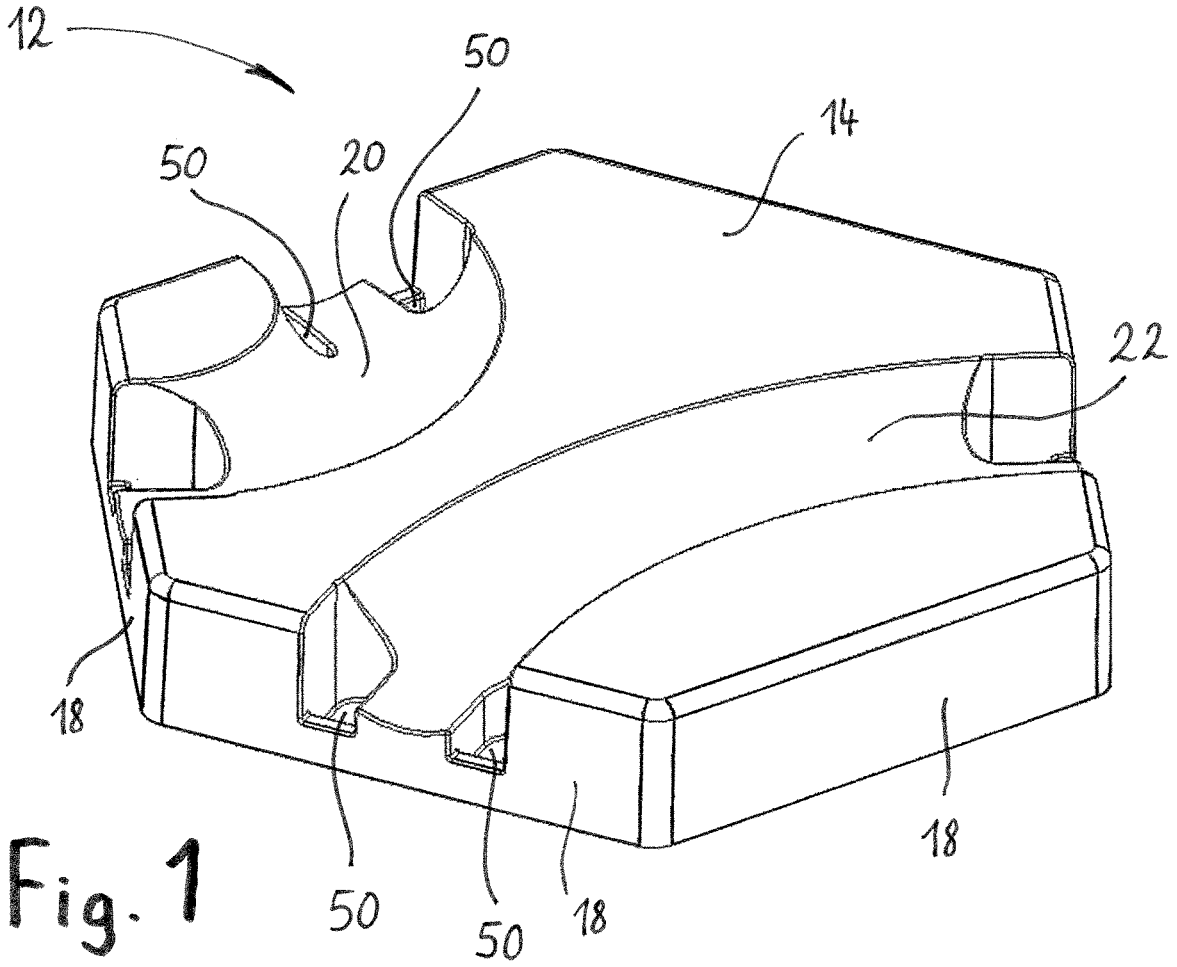

lying recesses (34) of the base (32) abut one another in a flush manner at a respective lateral surface (18).

20 Claims, 20 Drawing Sheets

(58) Field of Classification Search
USPC ..... 446/89, 118, 120, 127, 128, 168, 169, 446/170, 173
See application file for complete search history.

(56) References Cited

U.S. PATENT DOCUMENTS

| | | | | | |
|---|---|---|---|---|---|
| 5,344,143 | A * | 9/1994 | Yule | A63F 7/3622 | 273/118 R |
| 5,944,575 | A * | 8/1999 | Tolnay | A63F 7/3622 | 446/128 |
| 6,695,673 | B1 | 2/2004 | Stadbauer | | |
| D492,736 | S * | 7/2004 | Kato | D21/398 | |
| D712,491 | S * | 9/2014 | Hornsby | D21/564 | |
| D718,823 | S * | 12/2014 | Cunningham | D21/565 | |
| 9,925,471 | B2 * | 3/2018 | Flores | A63F 7/3622 | |
| 2014/0017970 | A1 * | 1/2014 | Comfort | A63H 18/02 | 446/168 |

FOREIGN PATENT DOCUMENTS

| | | | |
|---|---|---|---|
| DE | 202004007574 | U1 | 9/2005 |
| EP | 1150753 | B1 | 11/2001 |
| EP | 2384797 | A1 | 11/2011 |
| GB | 2285755 | A | 7/1995 |

OTHER PUBLICATIONS

German language International Preliminary Report on Patentability, dated Dec. 18, 2018, 17 pages.
English language International Search Report and Written Opinion, dated Apr. 18, 2018, 3 pages.

* cited by examiner

MODULAR BALL TRACK SYSTEM

CROSS REFERENCE TO RELATED APPLICATIONS

This is a national stage entry of International Patent Application No. PCT/EP2017/051820, filed Jan. 27, 2017, the disclosure of which is expressly incorporated herein by reference in its entirety.

The invention relates to a game in the form of a modular ball track system.

Games which use ball tracks have long been known, for example from German patent specification DE 34 02 726 C2, European patent specification EP 1 150 753 B1, U.S. Pat. No. 4,713,038 and from laid-open British patent application GB 2 285 755 A. Ball track systems of modular construction are also already known, for example from German utility model specification DE 20 2004 007 574 U1.

The object underlying the invention is to provide a ball track system which permits a wider variety of track configurations as compared with known ball track systems and which additionally is uncomplicated to handle, in particular as regards the building and dismantling of a ball track, and which, finally, can be manufactured inexpensively even in large numbers.

This object is achieved according to the invention by a modular ball track system which has the features of patent claim 1 or of patent claim 2. It is common to both main embodiments of the modular ball track system according to the invention that they comprise a plurality of module elements, all of which, in plan view, have the exterior shape of the same regular polygon. Each module element has an upper face, a lower face opposite the upper face, and a number of lateral surfaces corresponding to its number of corners. Each module element forms on its upper face at least one section of a ball track, which section passes through a lateral surface of the module element. In other words, the at least one section of the ball track formed on the upper face of each module element begins (or ends) at the one lateral surface of the module element, such that the ball track can be continued by a further ball track section of an adjacent module element. Preferably, the section of the ball track formed on the upper face of the module element is a recessed section, that is to say the ball track section is let into the upper face of the module element. Preferably, each module element of the plurality of module elements is disk-shaped, that is to say a height of each module element is significantly smaller than an extent of the module element in the other two spatial directions. According to a particularly preferred form of a modular ball track system according to the invention, the regular polygon is a regular hexagon but, in a departure therefrom, other embodiments in which the regular polygon is, for example, a square, a diamond, a triangle, a pentagon, an octagon, etc. are also possible.

In the first main embodiment, a plug base protrudes from each module element on the lower face thereof. A base plate belonging to the first main embodiment of the modular ball track system has a plurality of regularly arranged recesses for receiving in each case one plug base, wherein the plurality of recesses are arranged on the base plate in a grid and a grid dimension of the grid corresponds to the incircle diameter of the regular polygon forming the exterior shape of the module elements, Module elements fitted into recesses of the base plate that are located immediately adjacent to one another lie flush against one another with in each case one lateral surface. In correspondingly arranged module elements, the ball track sections formed on the upper faces of the module elements thus form a continuous ball track without the need for connecting elements between the individual module elements and without the individual module elements having to be fastened to one another.

According to the second main embodiment of the modular ball track system according to the invention, each module element has on its lower face a recess for receiving a plug base, and the base plate belonging to the second main embodiment has a plurality of regularly arranged plug bases for cooperating with in each case one recess, wherein the plurality of plug bases are again arranged on the base plate in a grid and a grid dimension of the grid corresponds to the incircle diameter of the regular polygon forming the exterior shape of the module elements. Analogously to the first main embodiment, module elements fitted onto plug bases of the base plate that are located immediately adjacent to one another lie flush against one another with in each case one lateral surface. The advantages arising therefrom correspond to those of the first main embodiment. Within the context of this description, grid dimension refers to the spacing between two recesses, or plug bases, located immediately adjacent to one another on the base plate.

An advantage of both the main embodiments of the modular ball track system according to the invention is that all the module elements have the same exterior shape, for example of a regular hexagon, and the same outside dimensions. This on the one hand permits inexpensive production, for example by a plastics injection molding process, and on the other hand, on account of the grid dimension, which corresponds to the incircle diameter of the chosen regular polygon forming the exterior shape of the module elements, leads to an enormous variety of possible combinations of the module elements on the base plate. The chosen grid dimension and the same exterior shape and size of the module elements further has the result that, despite the large number of possible combinations, a desired combination of module elements can be achieved in a straightforward manner in order to produce a desired ball track. The difference between the first main embodiment and the second main embodiment of the ball track system according to the invention lies merely in the transposition of the functional elements plug base and recess for receiving a plug base. While in the first main embodiment each module element has a plug base which protrudes from the lower face of the module element and can be fitted into one of the recesses of the base plate, each module element according to the second main embodiment has on its lower face a recess with which it can be fitted onto one of the plug bases arranged on the base plate. In both the main embodiments, the functional elements plug base and recess are in such a form that a slight gripping action is produced in the mutually connected state, which holds the respective parts together.

In principle, the form of each plug base can be independent of the exterior shape of the regular polygon forming the module elements. For example, the regular polygon can be a hexagon and the plug base can have a circular cylindrical form, the recess for receiving in each case one plug base then likewise being circular. Preferably, however, the form of each plug base and the form of each recess for receiving in each case one plug base is so chosen that two module elements arranged adjacent to one another can be fitted into or onto the base plate only in a position in which the module elements lie flush against one another with in each case one lateral surface. In other words, each plug base and each recess is so designed that cooperation of these two functional elements is possible only in positions corresponding to the number of corners of the chosen regular polygon, and namely in such a manner that module elements arranged adjacent to one another lie flush against one another with in each case one lateral surface. Particular preference is given to embodiments of the ball track system according to the invention in which the form of each plug base and the form of each recess for receiving in each case one plug base has the same shape as the regular polygon forming the exterior shape of the module elements, but with a smaller incircle diameter. If, for example, the chosen regular polygon is a hexagon, then the plug base and the recess for receiving the plug base also have a shape, fitting into one another, of a regular hexagon, the outside dimensions of which, owing to the smaller incircle diameter, are, however, smaller than the outside dimensions of the hexagon which forms the exterior shape of the module elements. Conformity between the exterior shape of the module elements and the form of the plug bases or of the recesses for receiving in each case one plug base facilitates intuitive combination of the individual module elements.

In order to increase the variability of the ball track system according to the invention further, preferred forms comprise, in addition to the plurality of module elements, also connecting rails for bridging a gap between two module elements which are not arranged immediately adjacent to one another, wherein each connecting rail forms a section of the ball track. Preferably, each connecting rail has two rods arranged parallel to one another which form the ball track section, which rods have a free end on both sides and are fixed to one another by a plurality of cross-members extending beneath the ball track transversely to the rods. As a result, such connecting rails have a ladder-like appearance. The free ends of the rods are preferably bent downwards in the manner of a hook in order to allow the connecting rails to be hooked into the module elements, as will be explained in greater detail hereinbelow.

The rods preferably have a cylindrical, in particular circular cylindrical, cross-section so that a ball is able to roll properly on the rods of a connecting rail arranged parallel to one another. The cross-members extending transversely to the rods can be so arranged that a ball rolling on a connecting rail does not touch them, which reduces the frictional resistance which a ball must overcome as it rolls.

Advantageously, connecting rails having rods and cross-members are in such a form that a cross-member is arranged close to each of the free ends of the rods and is extended upwards on both sides of the ball track to form guards which reduce the risk of a ball jumping from the connecting rail at the ends of the connecting rail. In addition, in the case of connecting rails having rods and cross-members, each rod is advantageously provided close to its free end on its upper side with a ramp-like elevation, so that a ball rolling on the connecting rail is lifted slightly in the region of the end of the connecting rail in order to be able to enter the ball track section formed on the upper face of a module element without difficulty from the connecting rail. This prevents a rolling ball from being jolted by possible differences in level as it moves from a connecting rail onto a module element, which could lead to the ball jumping out of the ball track.

For the simple and secure connection of connecting rails and module elements with one another, the module elements are preferably so constructed that each module element, immediately adjacent to the or each point at which a ball track section formed on its upper face passes through a lateral surface of the module element, has a pair of hooking openings for connecting rails let into the ball track on both sides. The free ends, bent downwards in the manner of a hook, of the cross-members of the connecting rails described above can be inserted into these hooking openings, for example. Preferably, the hooking openings are in such a form that they allow the connecting rails a predetermined degree of movement in the longitudinal direction of the ball track. In this manner, connecting rails, while being of constant length, can connect not only module elements that are in the same plane but also module elements that are arranged at different heights.

In order to be able to arrange module elements at different heights, preferred embodiments of ball track systems according to the invention comprise column elements of a predetermined height, wherein each column element either has on its lower face a plug base corresponding to the plug base of the module elements and on its upper face a recess corresponding to the recesses in the base plate for receiving in each case one plug base, in order to be compatible with the first main embodiment described at the beginning, or has on its lower face a recess corresponding to the recess of the module elements and on its upper face a plug base corresponding to the plug bases of the base plate, in order to be compatible with the second main embodiment mentioned at the beginning. Preferably, a ball track system according to the invention comprises column elements of different predetermined heights, for example column elements whose height corresponds to one height unit and column elements whose height corresponds to half a height unit.

Preferred embodiments of ball track systems according to the invention further comprise at least one intermediate plate, wherein the intermediate plate has a plurality of regularly arranged recesses for receiving in each case one plug base, which recesses correspond in shape and arrangement to the recesses of the base plate for receiving in each case one plug base, and wherein each recess of the intermediate plate is provided on its lower face with a plug base corresponding to the plug base of the module elements. An intermediate plate in such a form is compatible with the first main embodiment described at the beginning. Alternatively, the intermediate plate has a plurality of regularly arranged plug bases which correspond in shape and arrangement to the plug bases of the base plate for cooperating with in each case one recess, wherein each plug base of the intermediate plate is provided on its lower face with a recess corresponding to the recess of the module elements. Such a form of the intermediate plate is compatible with the second main embodiment described at the beginning.

The intermediate plates described hereinbefore, in conjunction with the column elements described above, allow intermediate levels arranged above the base plate to be produced, at which intermediate levels parts of the ball track are situated. Preferably, the or each intermediate plate is made of transparent material so that such an intermediate level allows sections of the ball track located beneath it to be visible. A plurality of intermediate plates allows an intermediate level that is larger in terms of surface area to be produced at the same level or allows a plurality of intermediate levels to be produced at different levels. The variability of a ball track system according to the invention is increased again in this manner.

The base plate of a ball track system according to the invention is preferably formed of a plurality of base plate segments which can be hooked together in the base plate plane. For example, dovetail-shaped projections and cutouts can be present at the edges of the base plate segments, which projections and cutouts cooperate with corresponding dovetail-shaped projections and cutouts on another base plate segment. Dividing the base plate into base plate segments facilitates the packing and transport of ball track systems according to the invention and additionally allows the surface area of a base plate to be enlarged as desired.

Although the plurality of module elements of a ball track system according to the invention all have, in plan view, the exterior shape of the chosen regular polygon, they can additionally differ from one another in many different ways. For example, a ball track system according to the invention can comprise a plurality of module elements on the upper face of which there are formed a first curved ball track section and a second curved ball track section, wherein the first ball track section has a more pronounced curve than the second ball track section. Such module elements can be combined with one another in many ways in order to produce more or less curved ball track runs or to produce desired changes of direction of a ball track.

A ball track system according to the invention can further comprise at least one module element having a central opening which communicates with the at least one ball track section formed on the upper face of the module element and can receive a functional insert which is associated with the at least one section of the ball track. For example, such a functional insert can receive a ball arriving on the ball track section and allow it to fall down through a hole onto another level of the ball track if the central opening is in the form of a through-opening. Alternatively, such a functional insert can be in the form of a start ramp, from which a ball starts to roll down a ball track that has been constructed. In principle, such a module element having a central opening for receiving a functional insert also permits more rational production of module elements having different functions, since the module element itself can be of the same construction in each case and the different function is achieved only by means of the functional insert inserted into the central opening.

Preferred forms of a ball track system according to the invention additionally comprise module elements in which the at least one ball track section formed on the upper face of the module element contains an action element, such as, for example, points, a loop, a ball-lift mechanism, a catapult, a funnel, etc. Such action elements allow particularly exciting ball track runs to be produced.

A ball track system according to the invention will normally comprise a plurality of balls of the same size and the same weight. However, it is also possible, alternatively or in addition, to provide balls of the same size and a different weight, in order also to be able to produce a different gameplay by means of the balls themselves.

In addition or alternatively, a ball track system according to the invention can also include balls having different magnetic properties, whereby the gameplay can likewise be influenced.

Finally, balls of ball track systems according to the invention can also comprise an integrated RFID chip in order thus to be able to interact with electrical or electronic components of ball track systems according to the invention. For example, ball track systems according to the invention can contain sensors which are able to distinguish the balls on the basis of the RFID chip contained therein, in order thus to be able to influence the gameplay in dependence on specific balls by means of actuators which are likewise present. Thus, a ball held on a module element can only be released, for example, when specific balls are detected on other module elements. It is also possible to perform electronic time measurement by means of such RFID balls, in order to determine which ball reaches a given target the quickest. Module elements with electronic properties can be used to produce module elements having the following properties:

- Points with electronic switching of the position of the points.
- Module elements in which the ball falls onto a lower level, and gates can be electronically opened purposively or in a time-controlled manner.
- Module elements in which a ball is accelerated can be triggered purposively or in a time-controlled manner.
- Module launch pad with a pushbutton starts electronic time measurement when the balls are released.
- Module elements detect the incoming balls via a color sensor and determine the sequence in which the balls arrive.
- Module elements stop the time measurement when a specific number of balls or balls of specific colors have arrived (adjustable).
- Module elements can read RFID tags. They can thus purposively determine individual balls and react differently.
- Module elements which detect, via an optical or electrical sensor (a contact is closed), when a ball crosses the module element or rolls into the module element.
- Module elements contain light barriers for speed measurement.
- Module elements can contain built-in sound emission: sound is played when a previously defined condition occurs (e.g. ball passes through the module element, or a ball reaches the target).
- a Module elements can contain a built-in light source (typically LED). Light source illuminates when a previously defined condition occurs (e.g. ball passes through the module element, or a ball reaches the target). The light source can illuminate in different colors.
- Module elements can have their own power supply (e.g. via rechargeable or non-rechargeable and replaceable batteries).
- Module elements can have an integrated processor with which they are able to independently evaluate incoming signals and trigger reactions.
- Module elements can have a radio module with which they can communicate with one another and/or with a central unit.
  - The central unit can have its own power supply and can communicate via radio with all electronic module elements having a radio module. The properties of the electronic module elements can be adjusted via the central unit. A logic operation between electronic module elements can also be established via the central unit. (Example: points switch only when a defined ball has entered the target).
  - The central unit can be controlled via input elements (e.g. pushbuttons, switches). A built-in loudspeaker or a built-in screen can serve as the output element.
  - Alternatively, the central unit can communicate via radio with a smart device (smartphone, tablet, PC). All adjustments to the central unit (e.g. parameterization and programming of the electronic module elements) can be carried out via the smart device.
- Electronic module elements can have a radio module with which they can communicate directly with a smart device (smartphone, tablet, PC) with suitable software (app).
- The typical parameters of each module element can be adjusted in the module elements via radio (according to the module element, for example, release condition, waiting times, logic functions . . . ).

The electronic module elements report their status and status changes to the central unit or to a smart device or directly to other electronic module elements via radio.

Electronic module elements can have switches or push-buttons on the module element via which typical parameters of the module element can be adjusted on the module element directly.

Finally, it is also possible to expand ball track systems according to the invention in conjunction with, for example, a smartphone, tablet or a PC and special software (for example in the form of an app) with so-called augmented reality or virtual reality.

If the ball track is viewed via special software (e.g. app) through the camera of a smart device (e.g. smartphone, tablet, PC), the ball track is brought to life. Movable and fixed parts of the track are supplemented and/or replaced in the video image by virtual graphics. Sound effects are played to suit the position of the balls.

By means of a camera in a smart device (e.g. smartphone, tablet, PC), images of the track are made. The data are electronically evaluated and further processed by suitable software on the smart device or on servers. The spatial dataset so produced is the basis for the software for calculating the number and type of module elements used. The software then produces suitable building instructions which can be stored on the smart device.

If the track is viewed via special software (e.g. app) through the camera of a smart device, the position of the balls is detected in real time. The smart device correspondingly controls electronic module elements having a radio module while the ball is running through the track.

Figure 2:
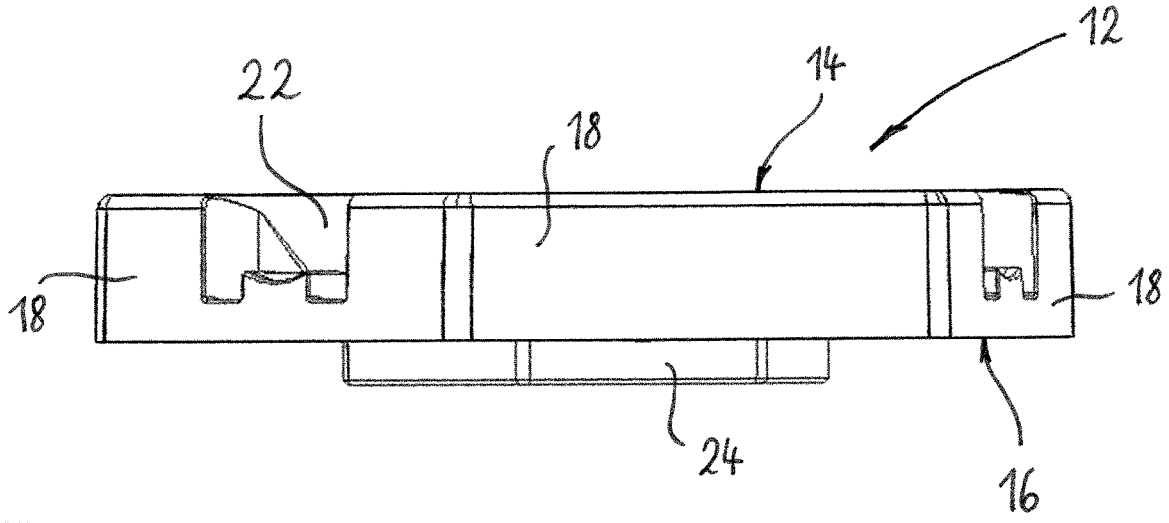
Figure 3:
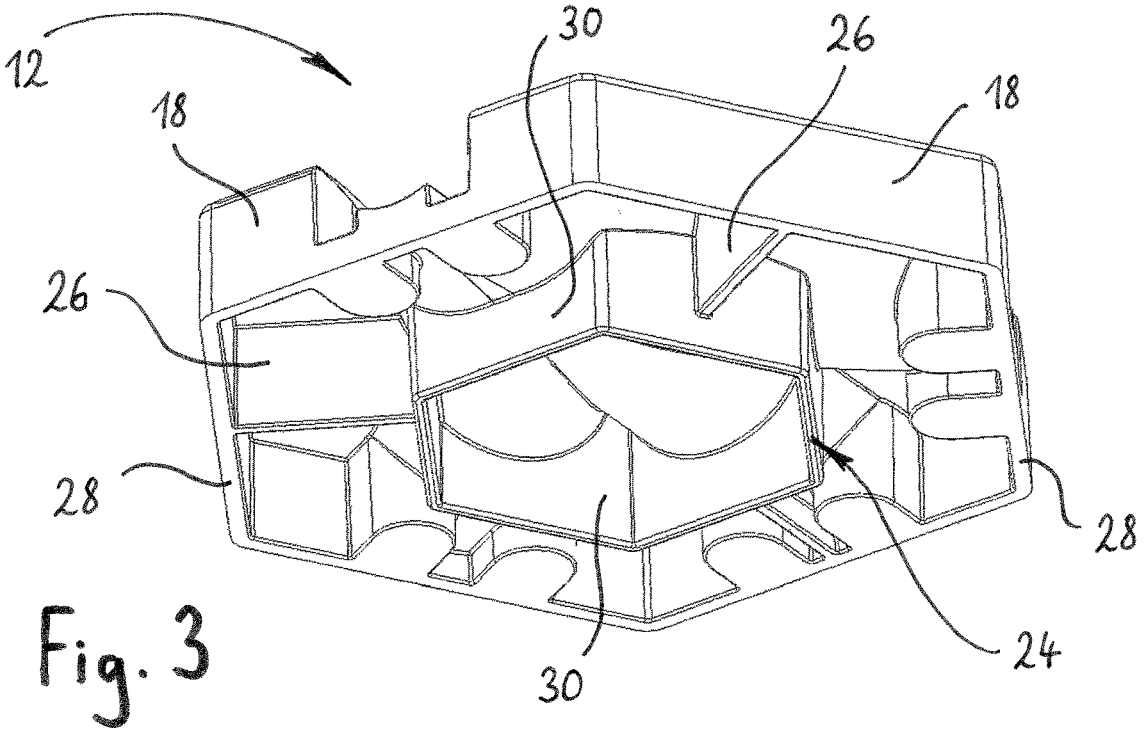
Figure 4:
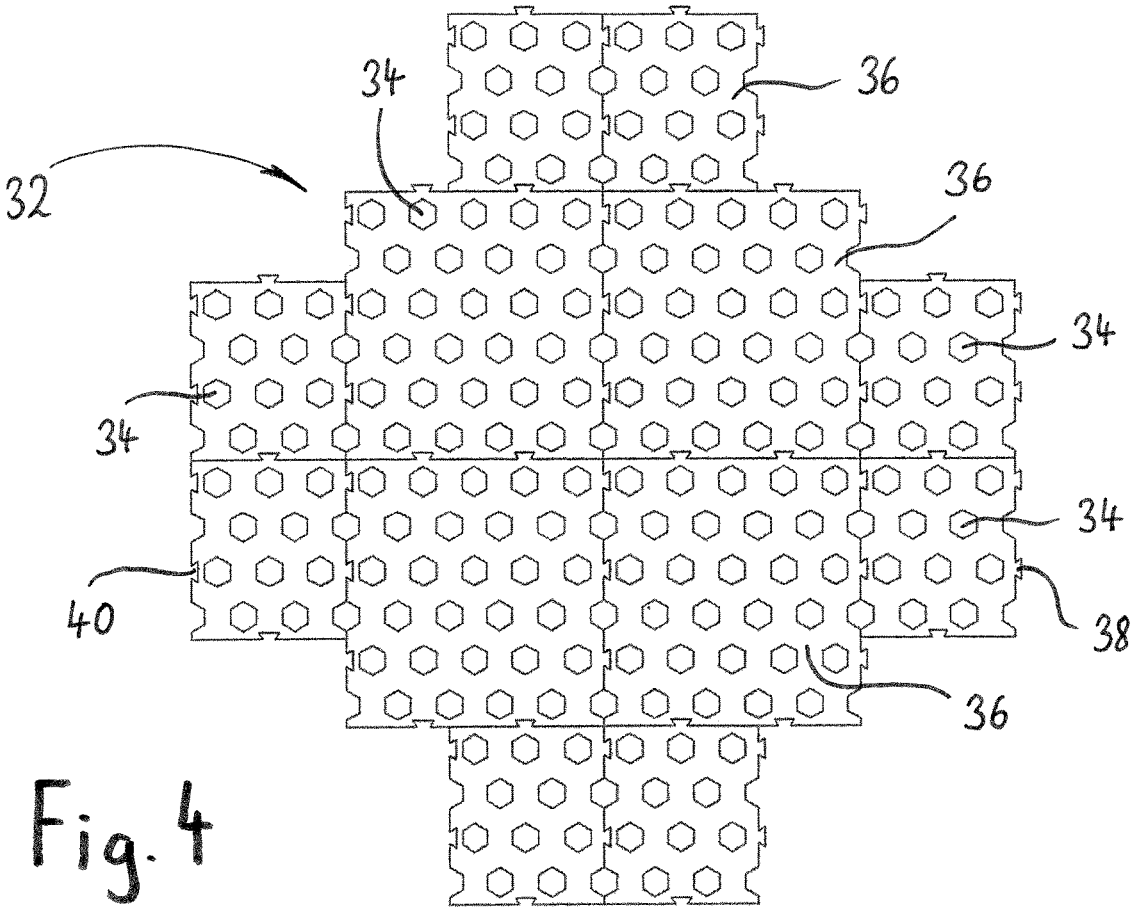
Figure 5:
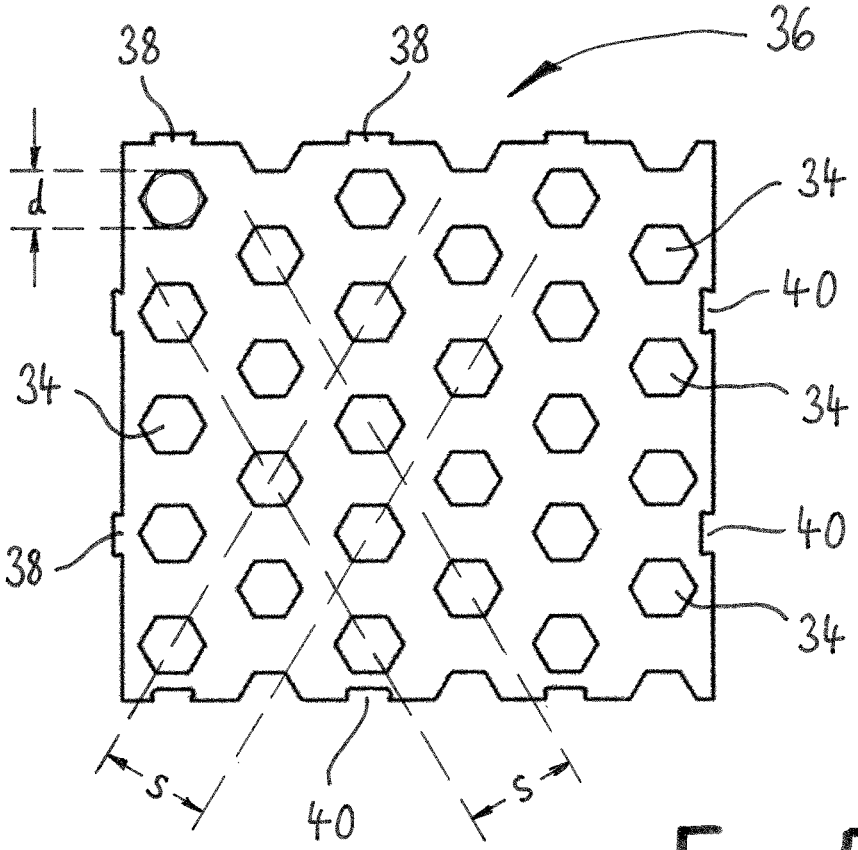
Figure 6:
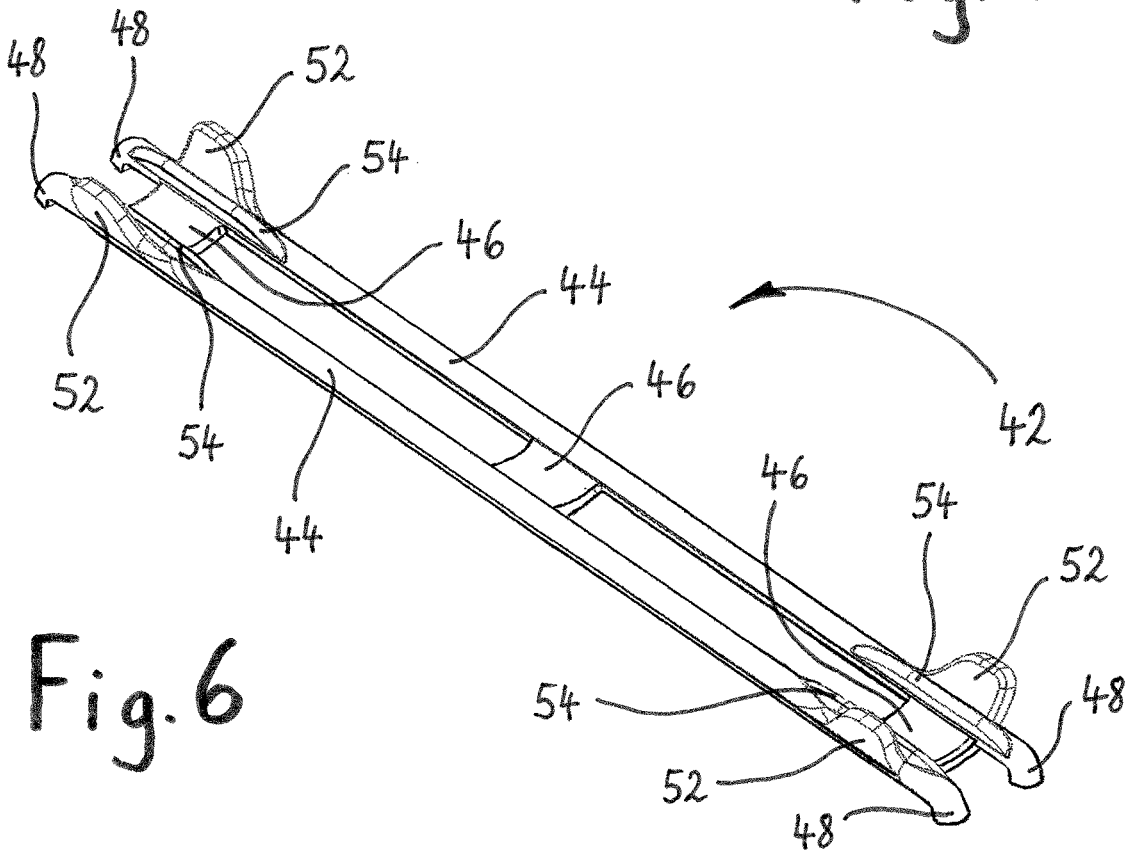
Figure 7:
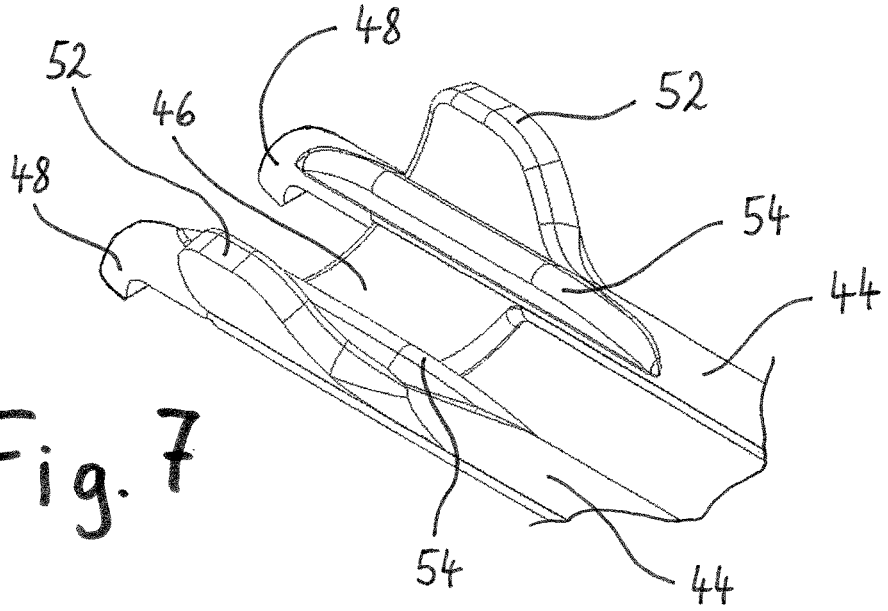
Figure 8A:
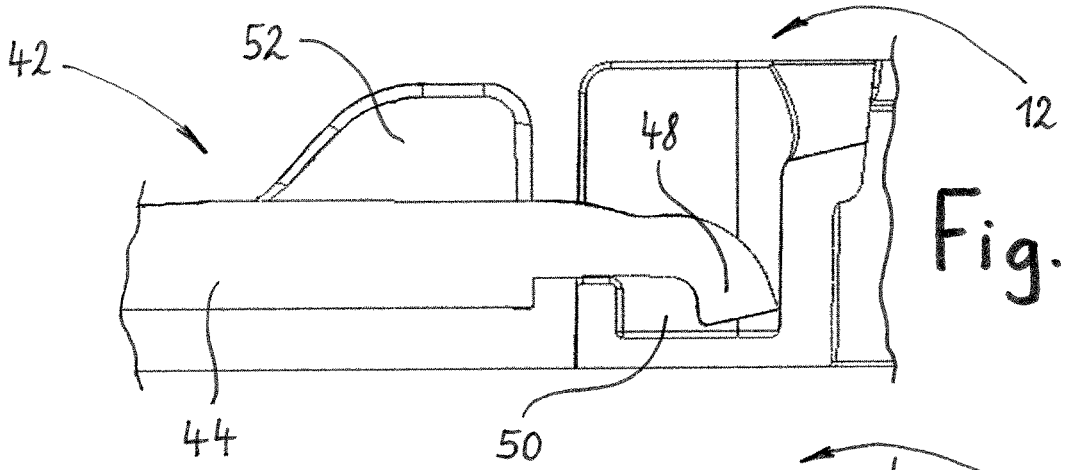
Figure 8B:
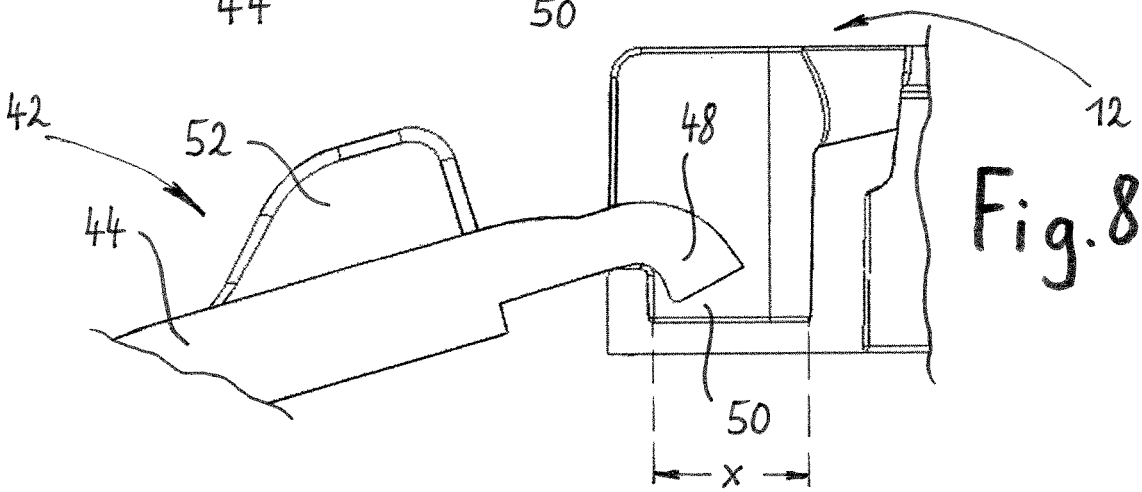
Figure 9:
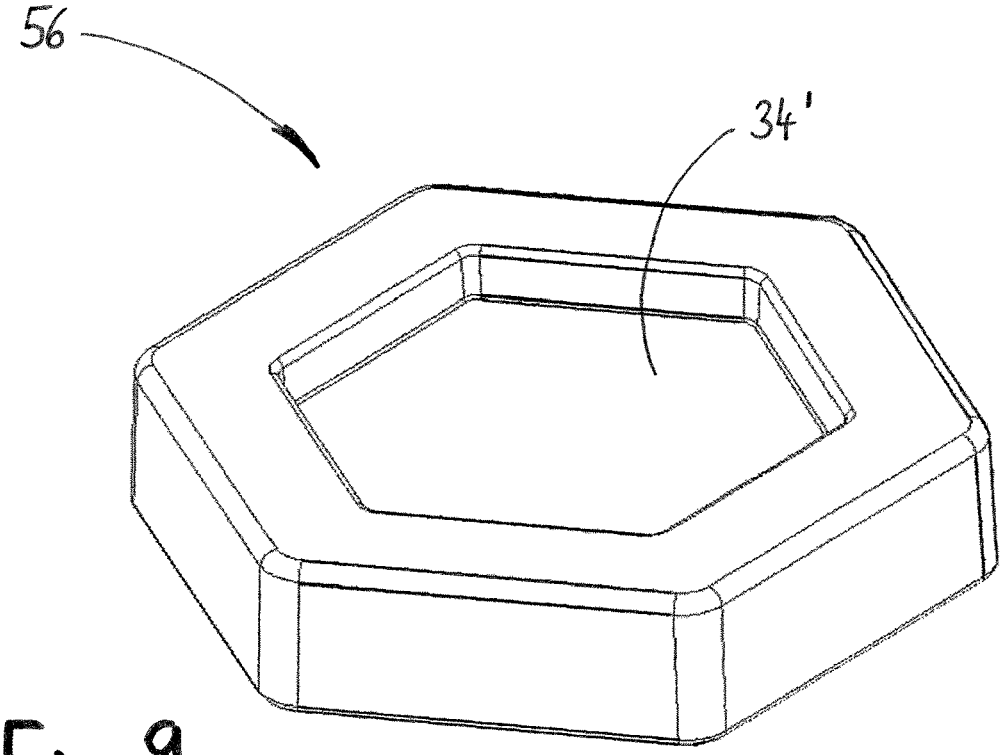
Figure 10:
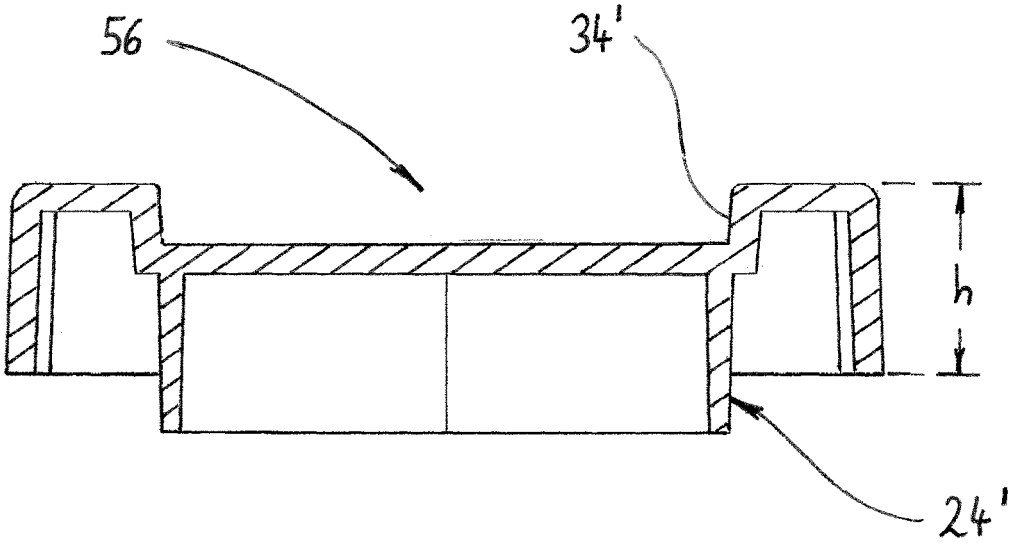
Figure 11:
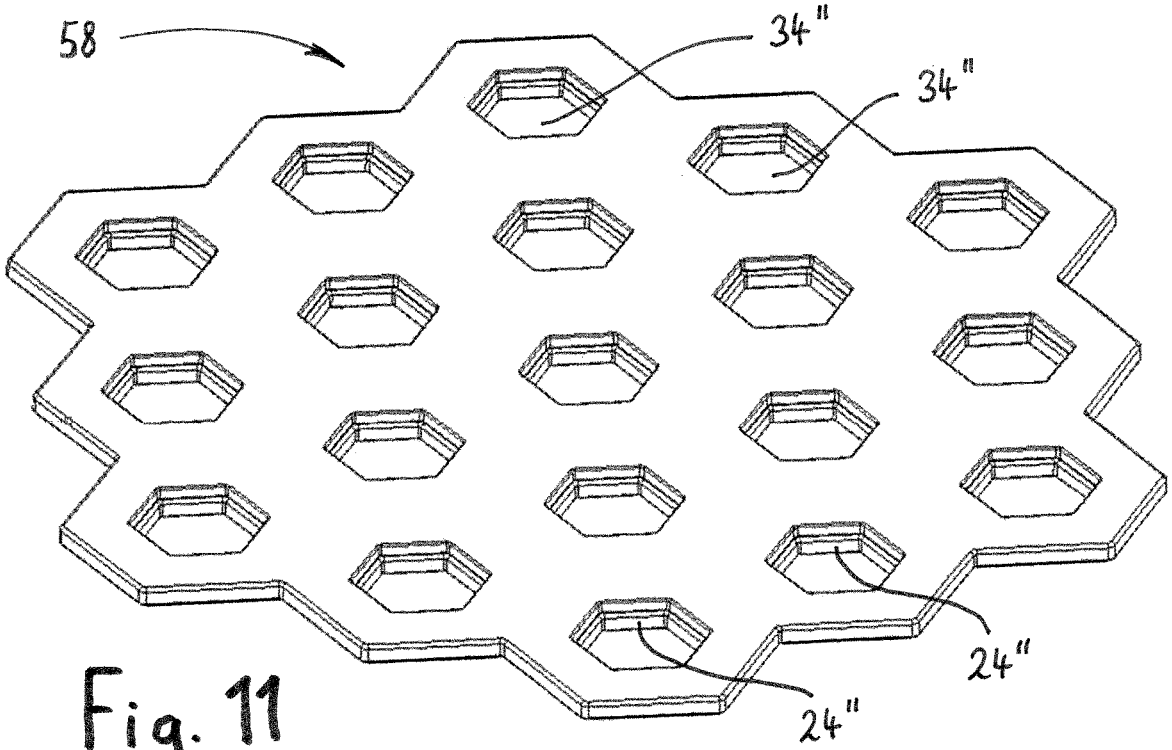
Figure 12:
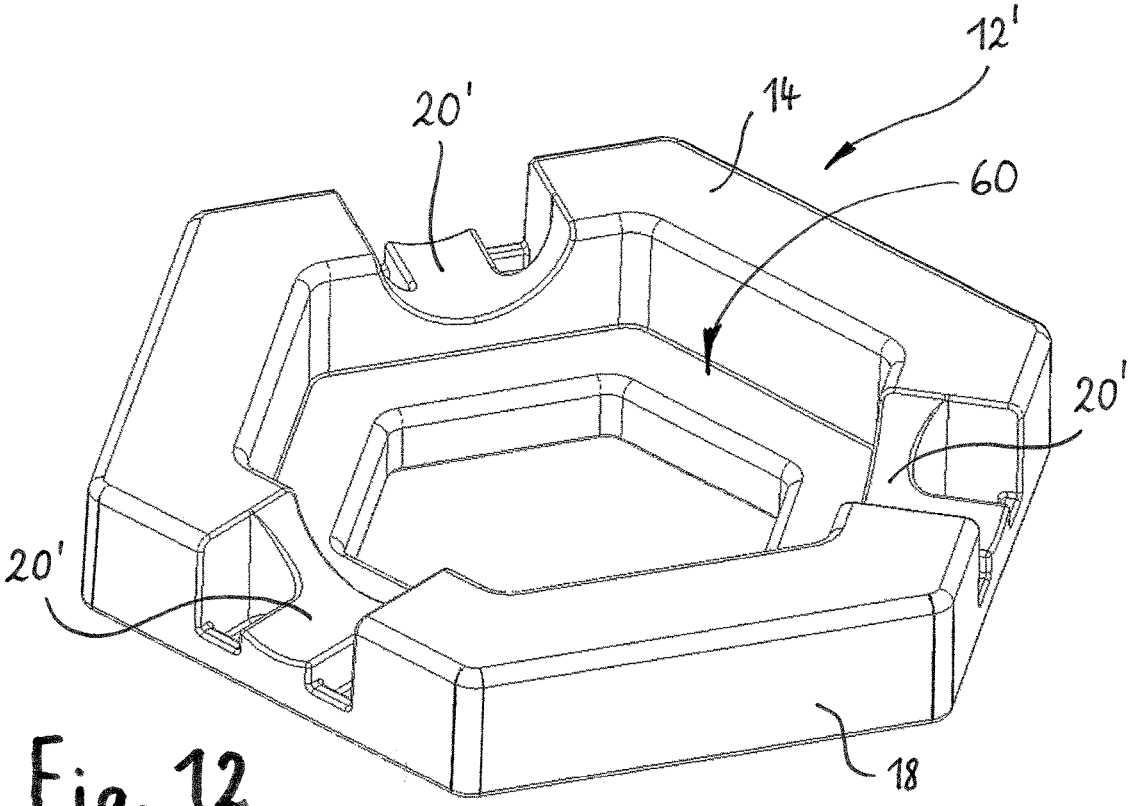
Figure 13A:
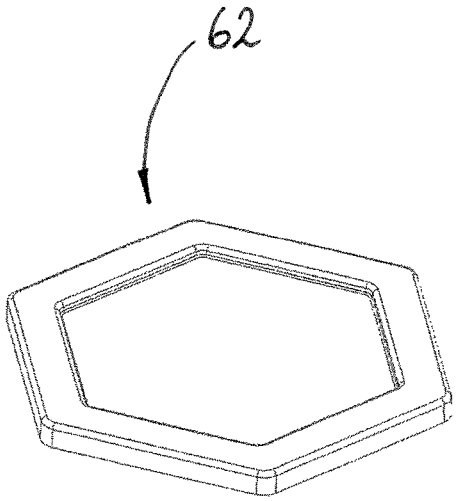
Figure 13B:
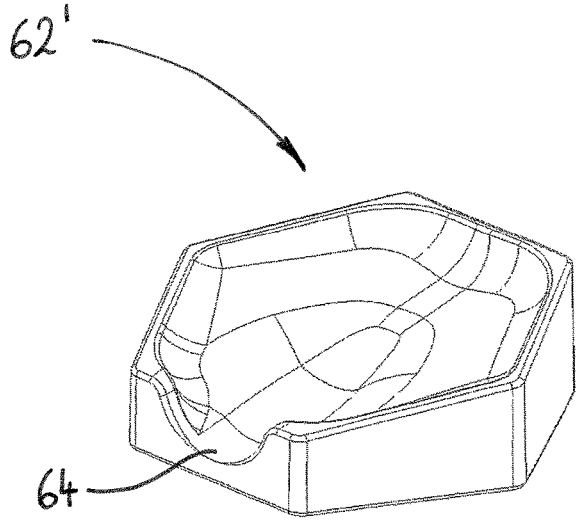
Figure 13C:
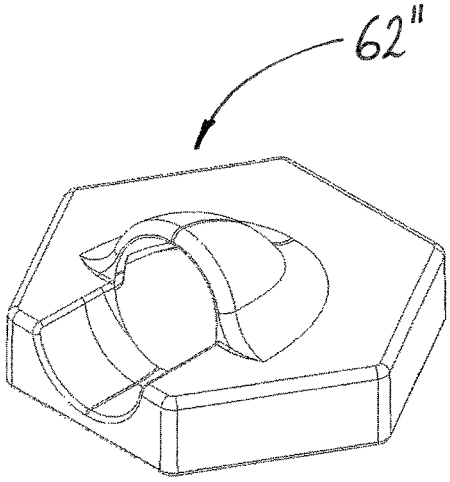
Figure 13D:
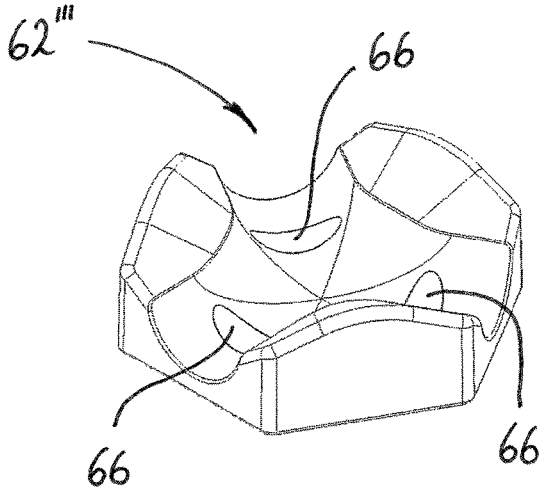
Figure 14:
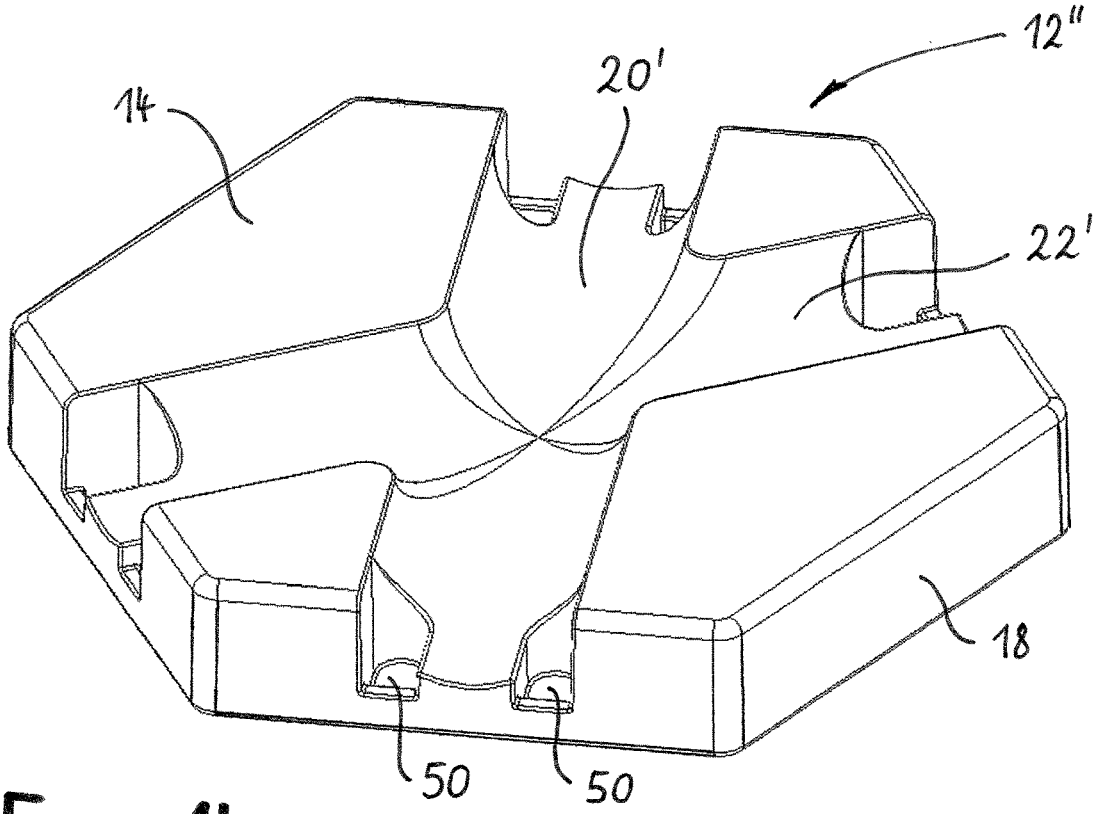
Figure 15:
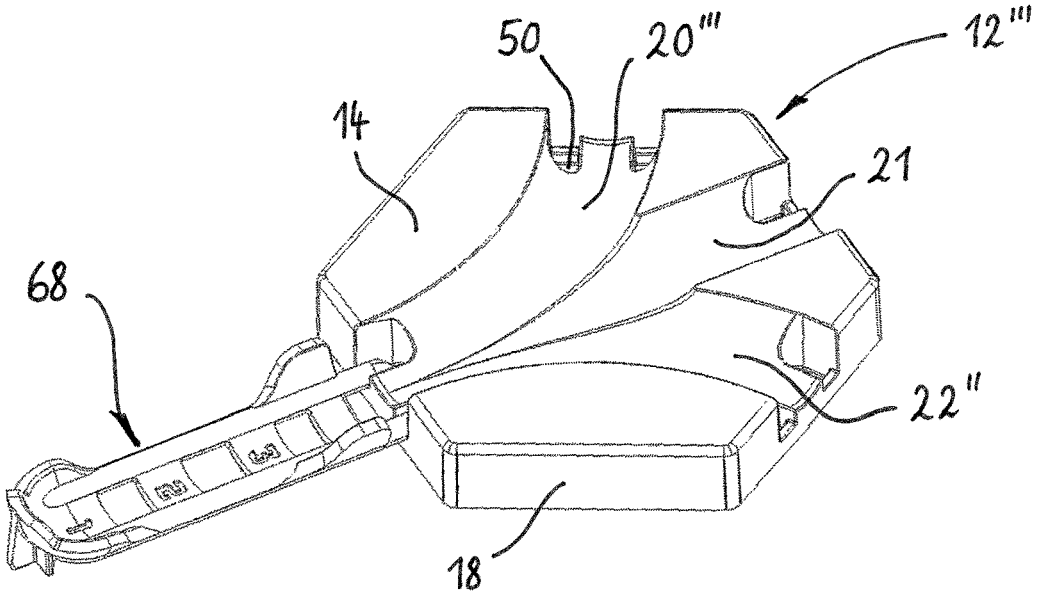
Figure 16:
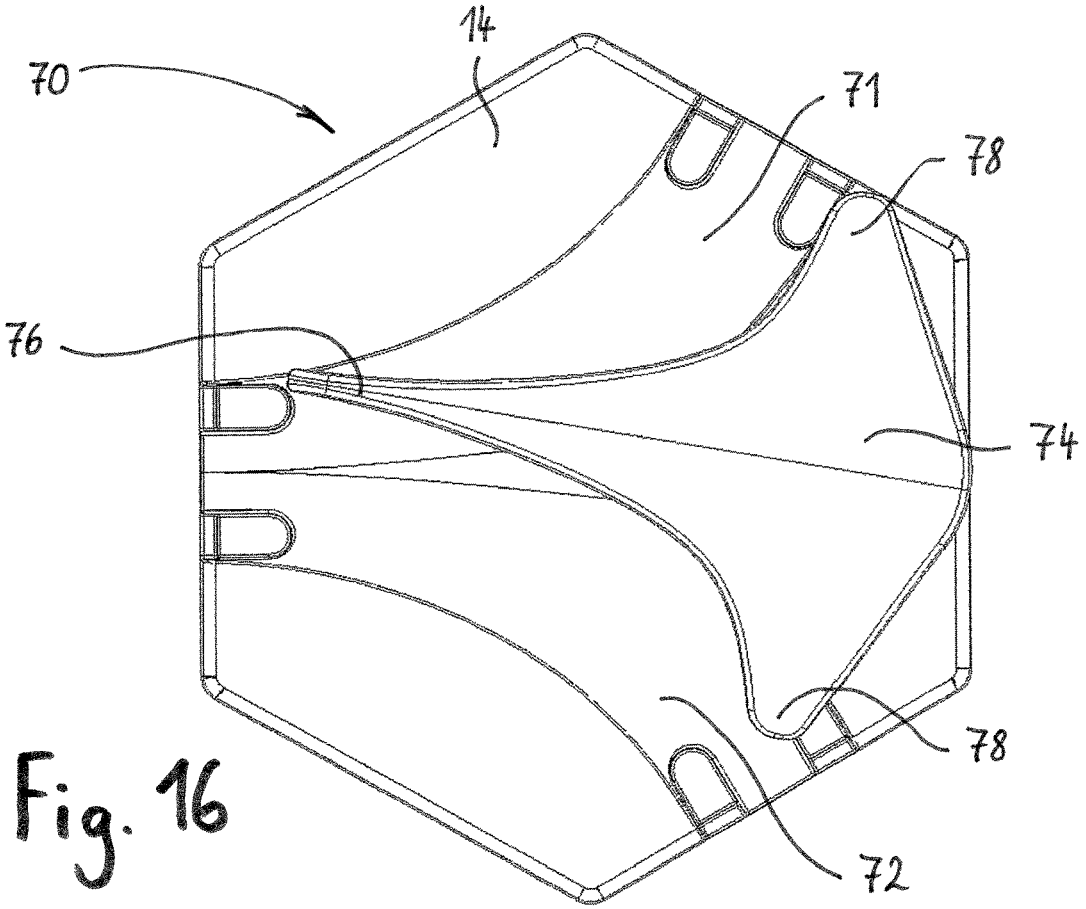
Figure 17:
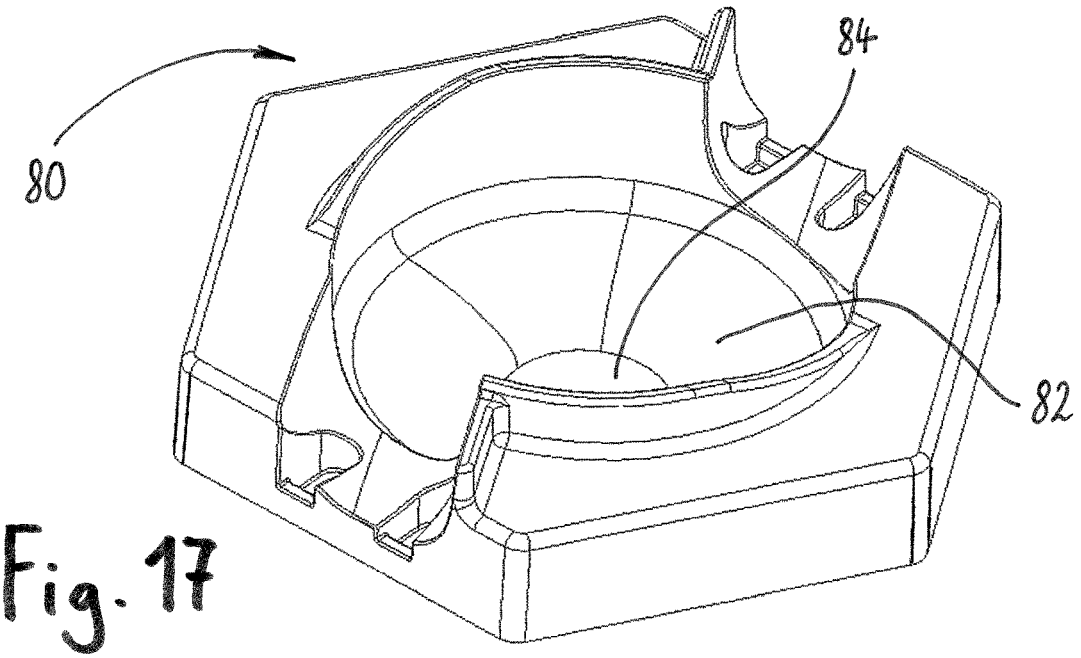
Figure 18:
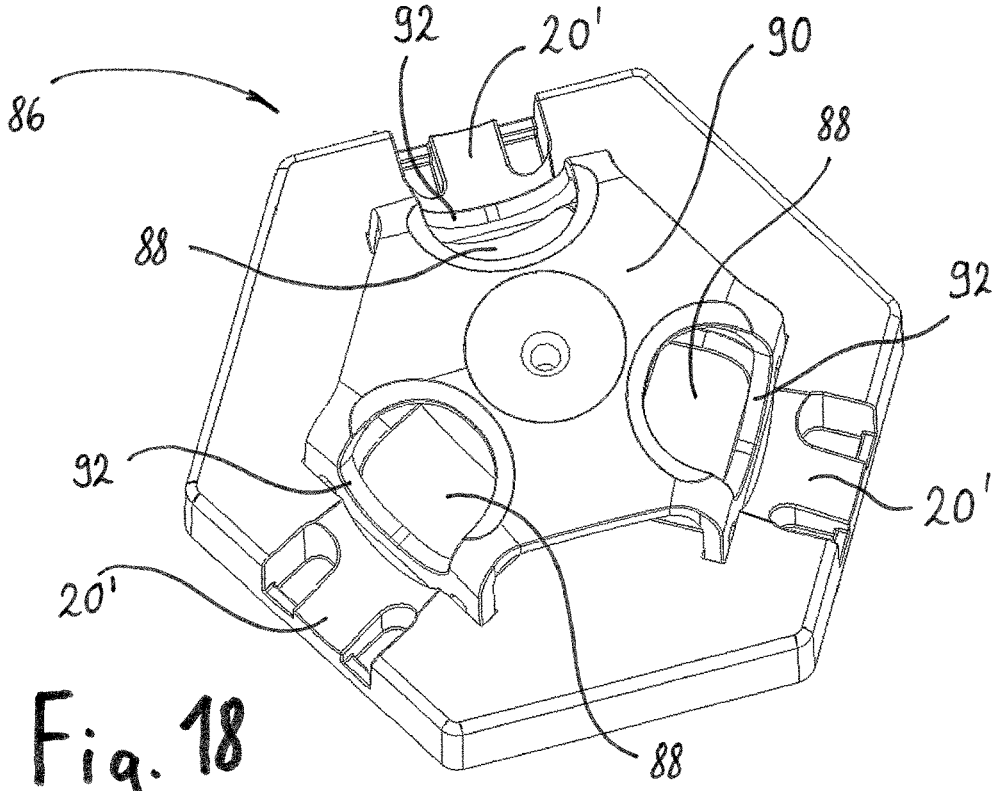
Figure 19:
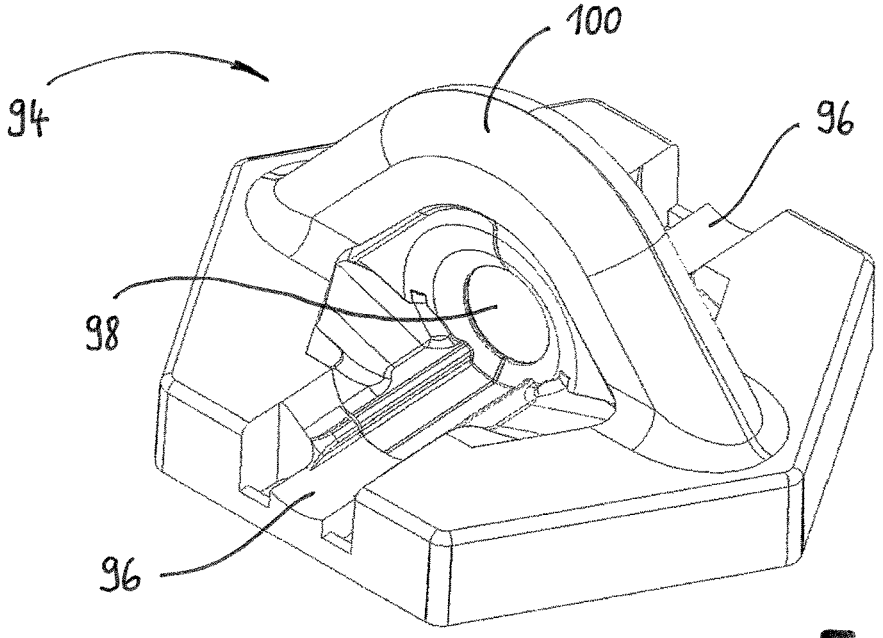
Figure 20:
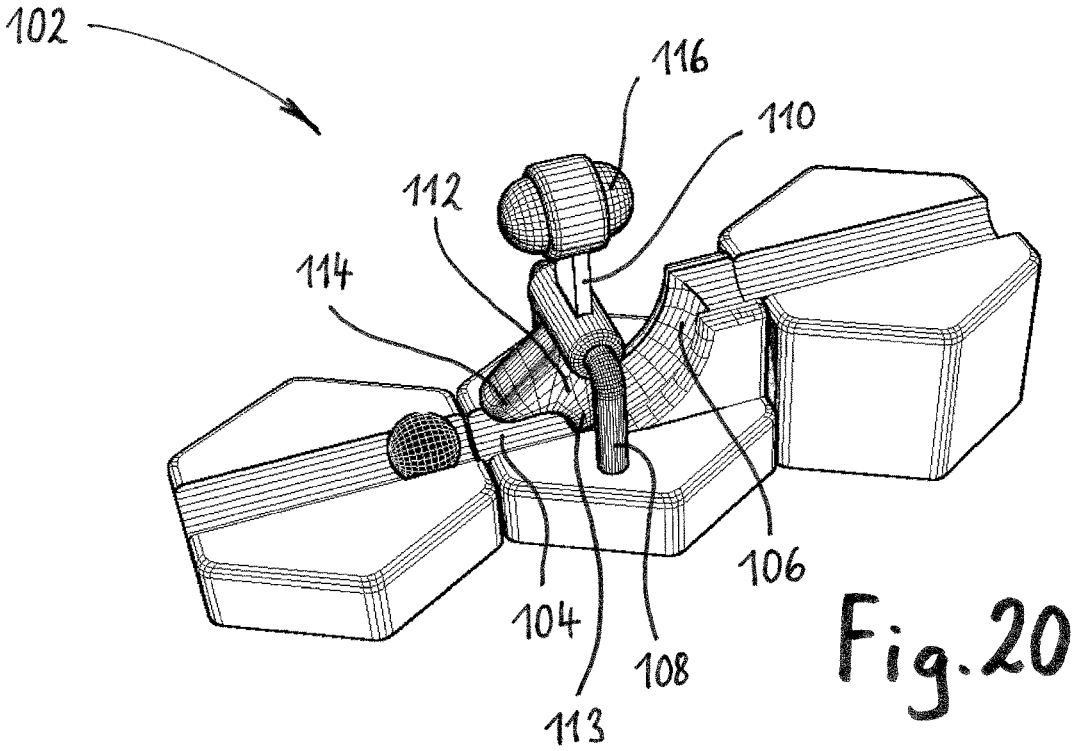
Figure 21:
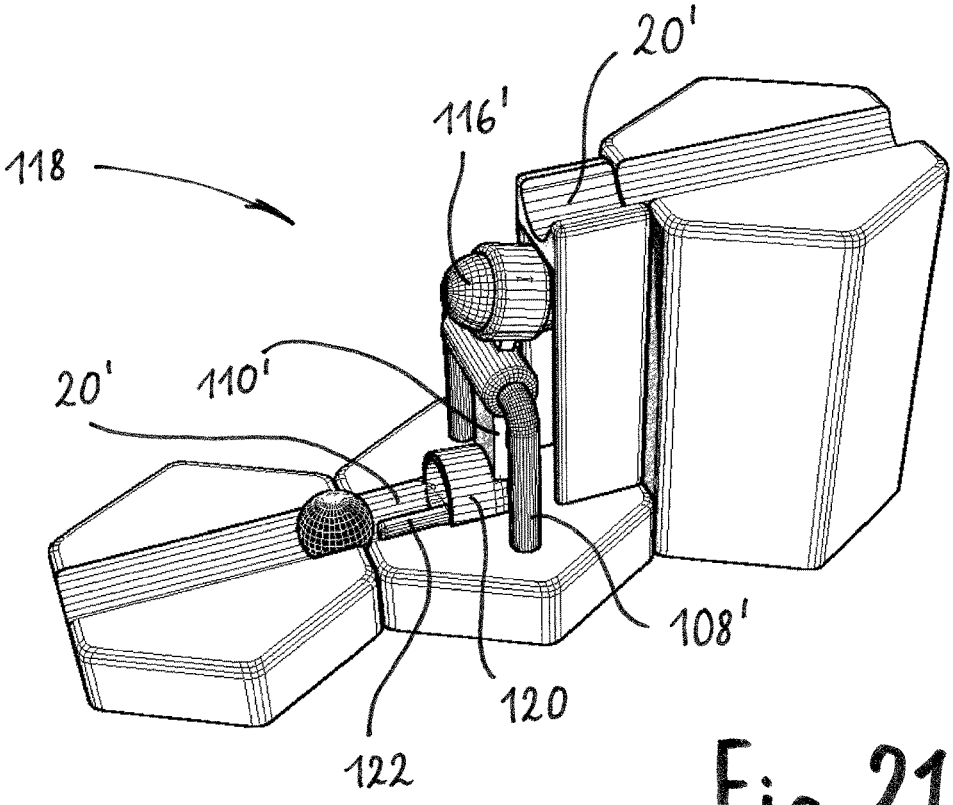
Figure 22:
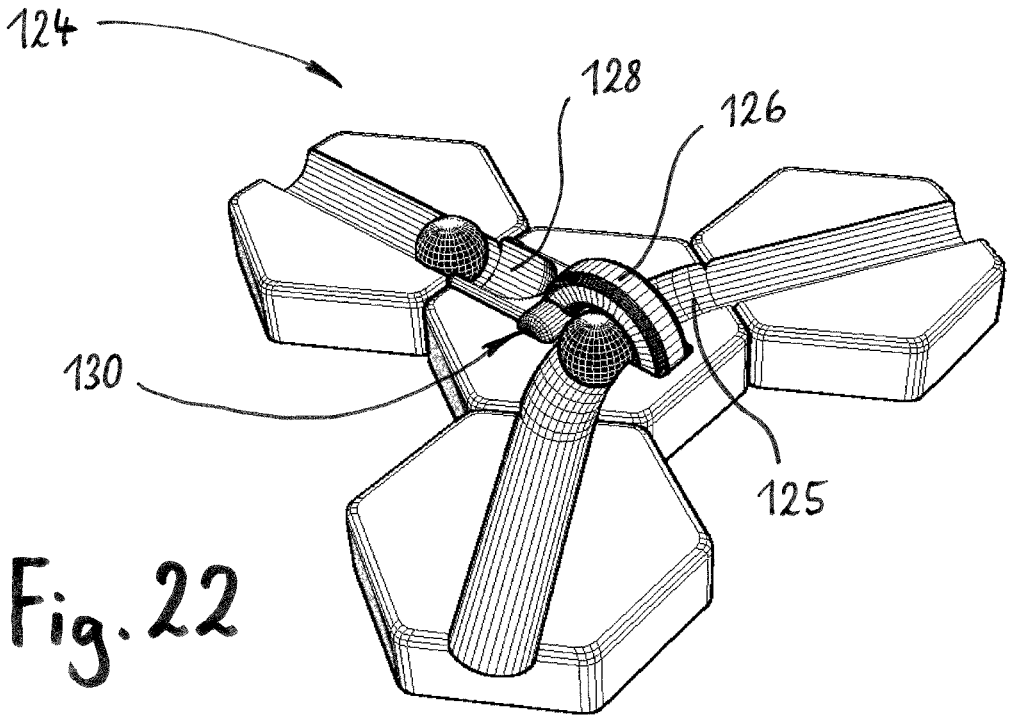
Figure 23:
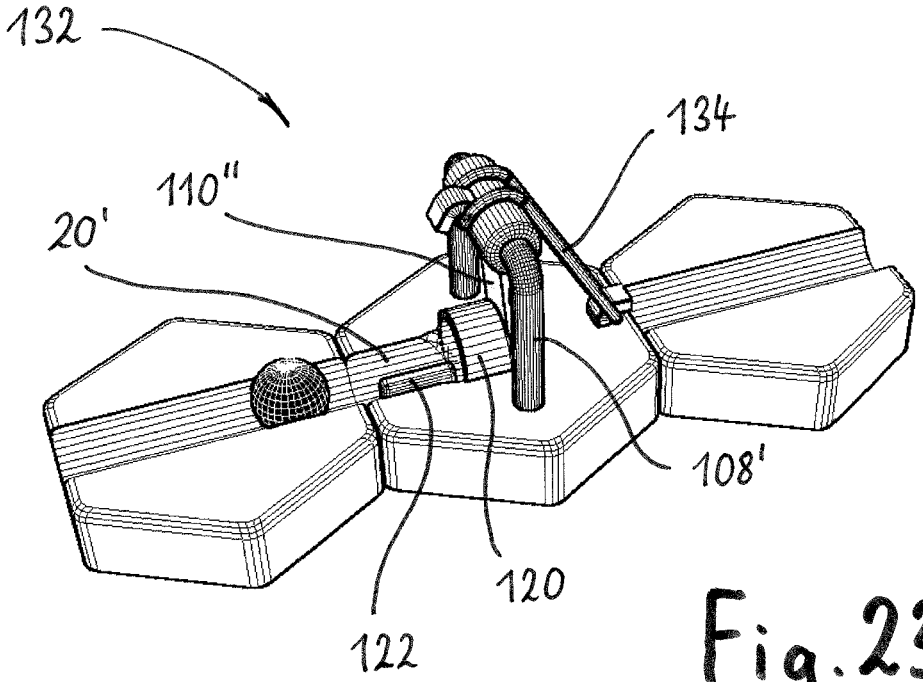
Figure 24:
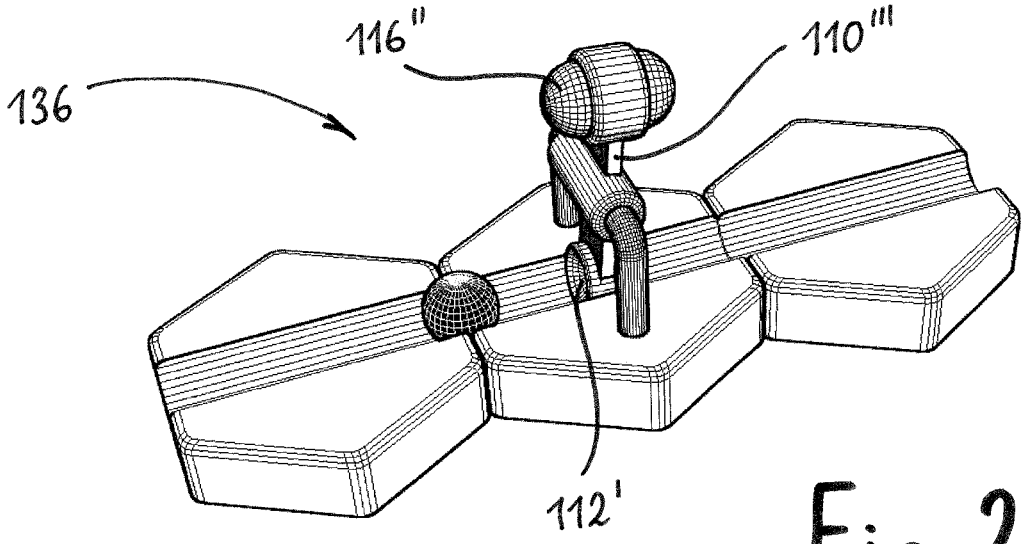
Figure 25:
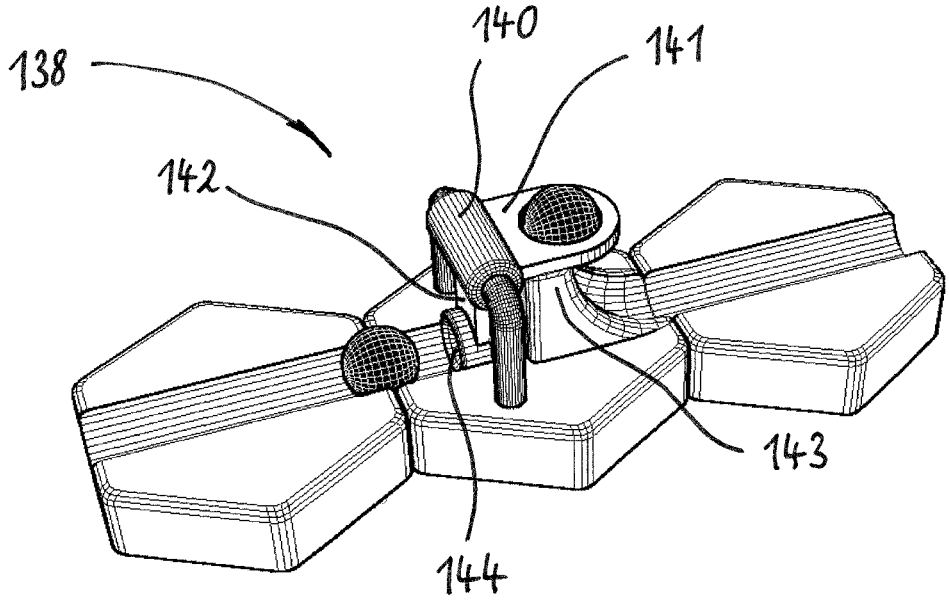
Figure 26:
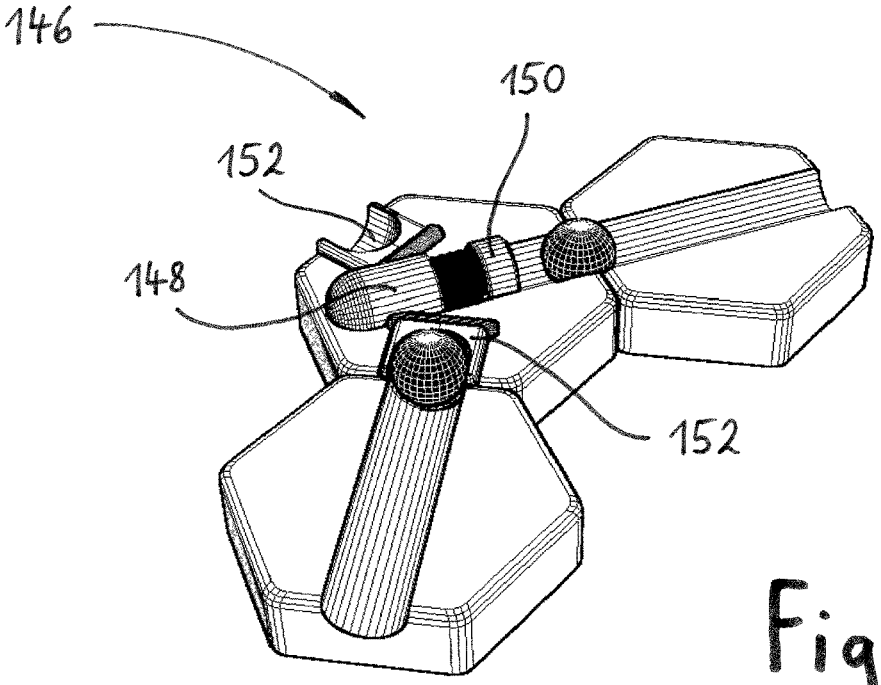
Figure 27:
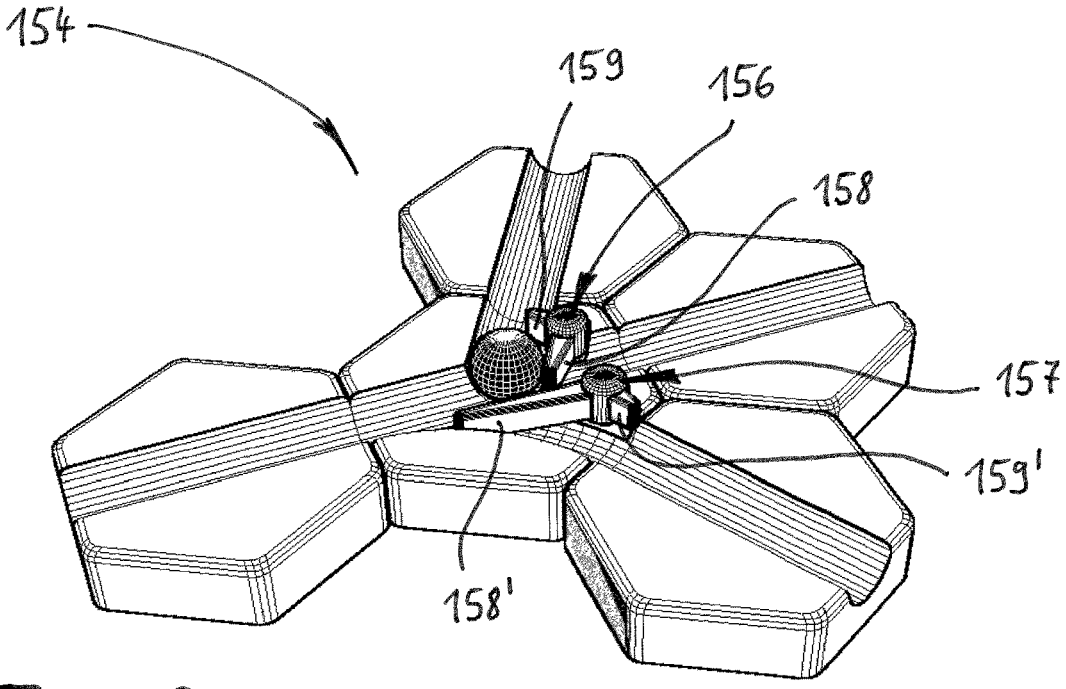
Figure 28:
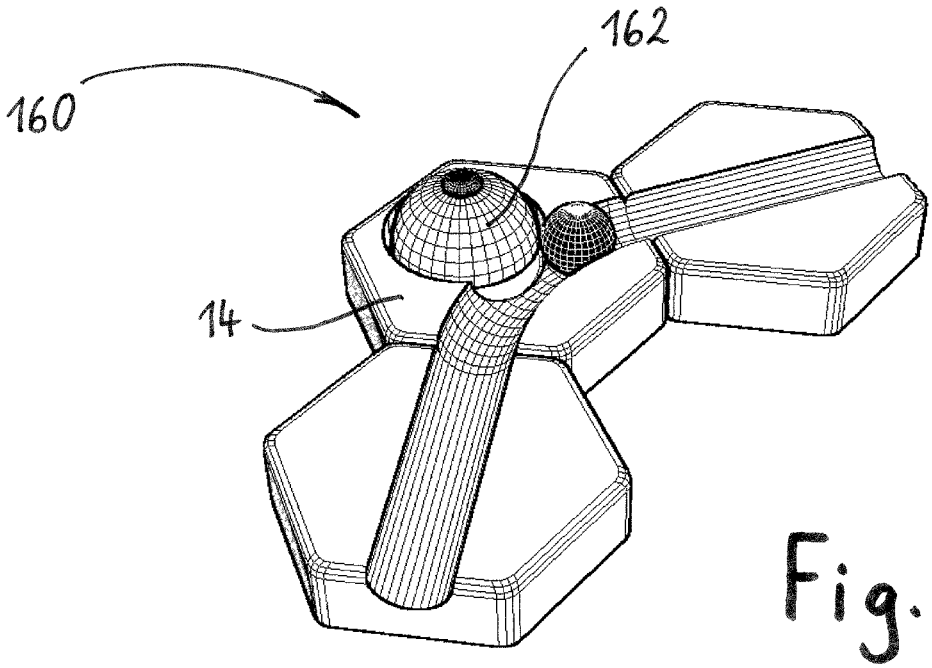
Figure 29:
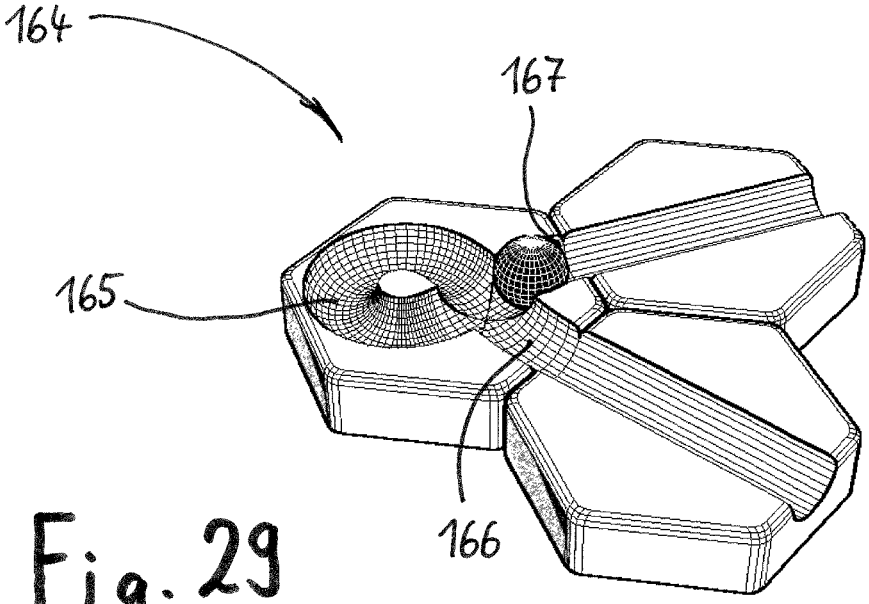
Figure 30:
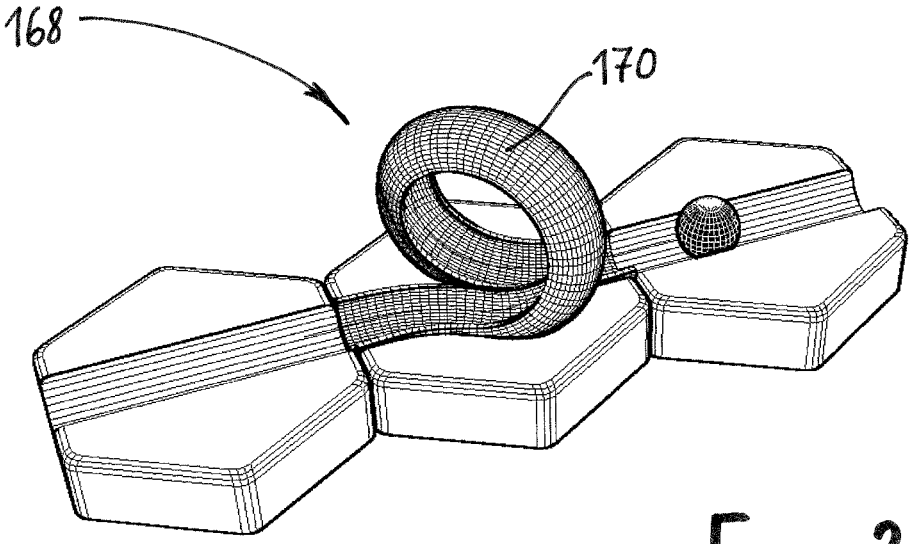
Figure 31:
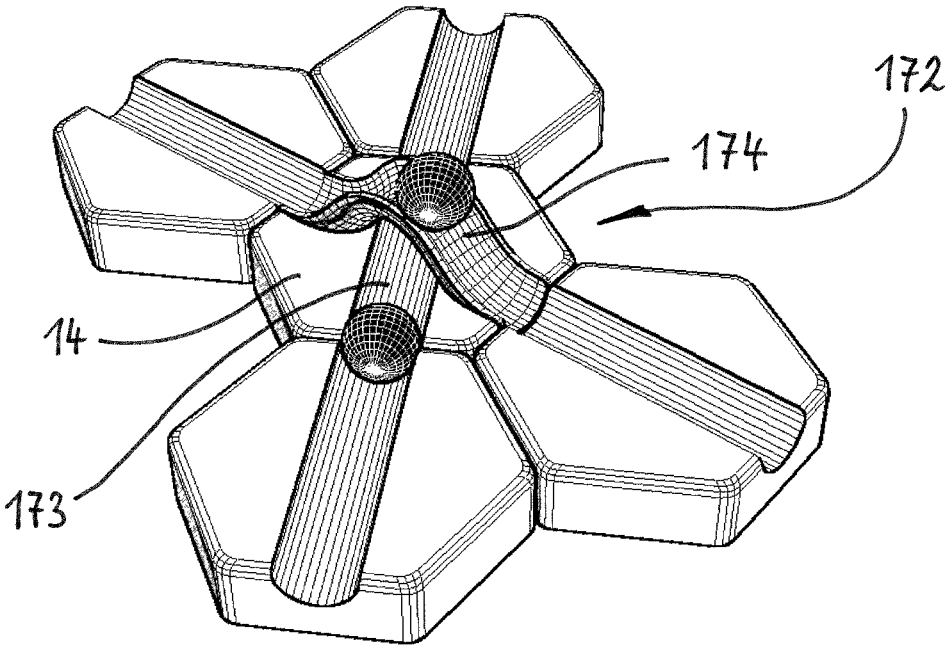
Figure 32:
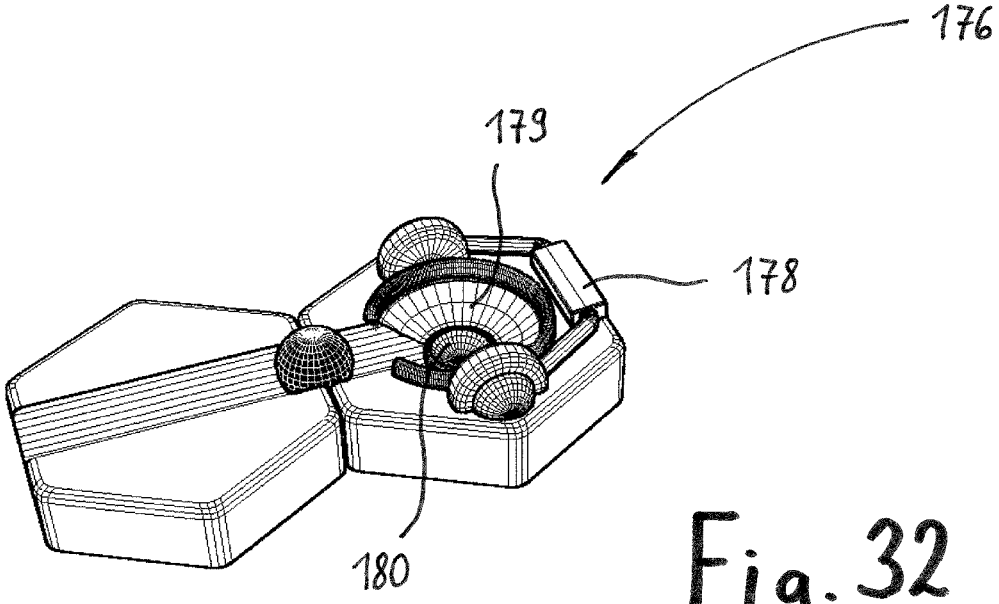
Figure 33:
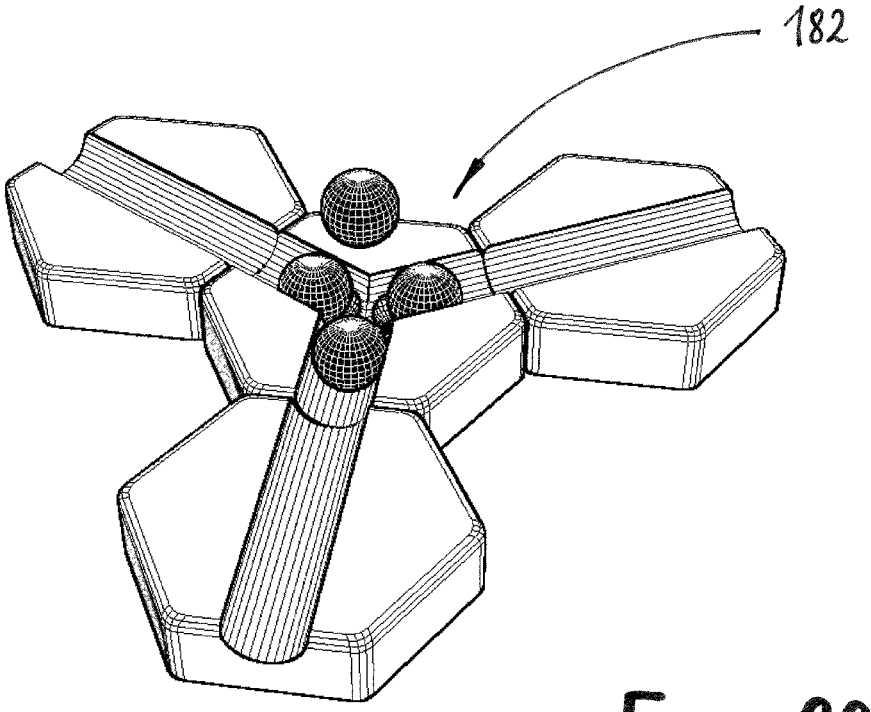
Figure 34:
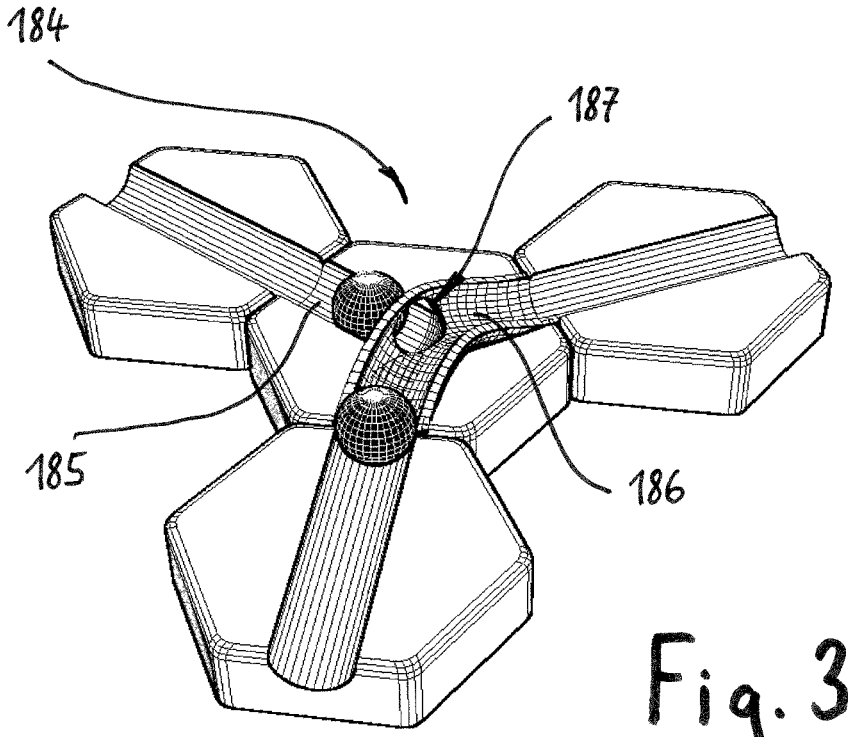
Figure 35:
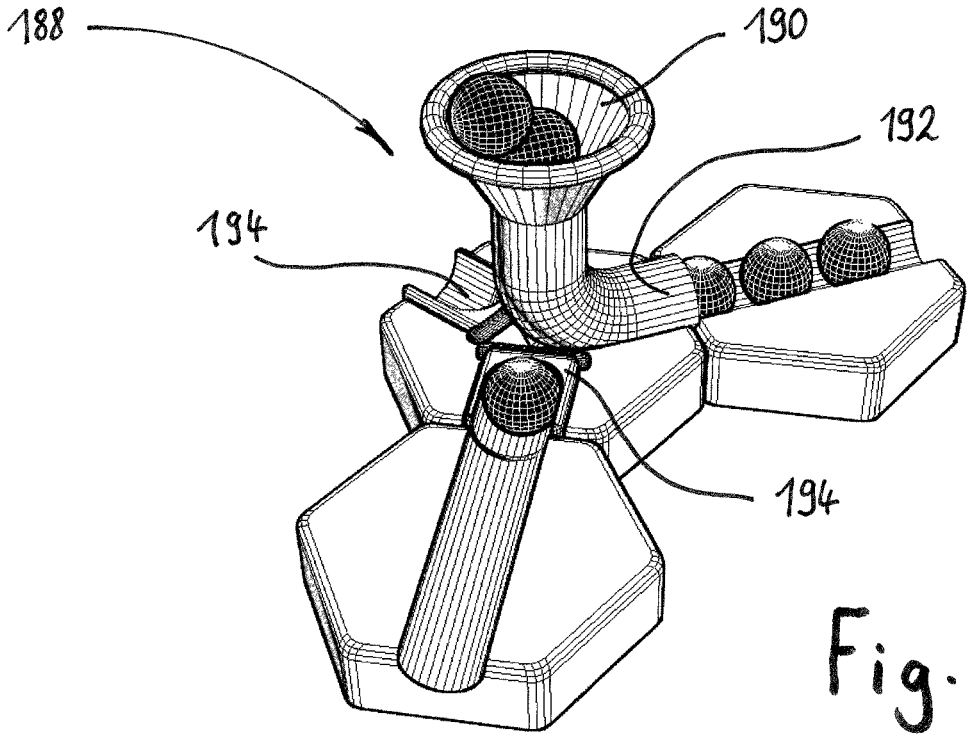
Figure 36:
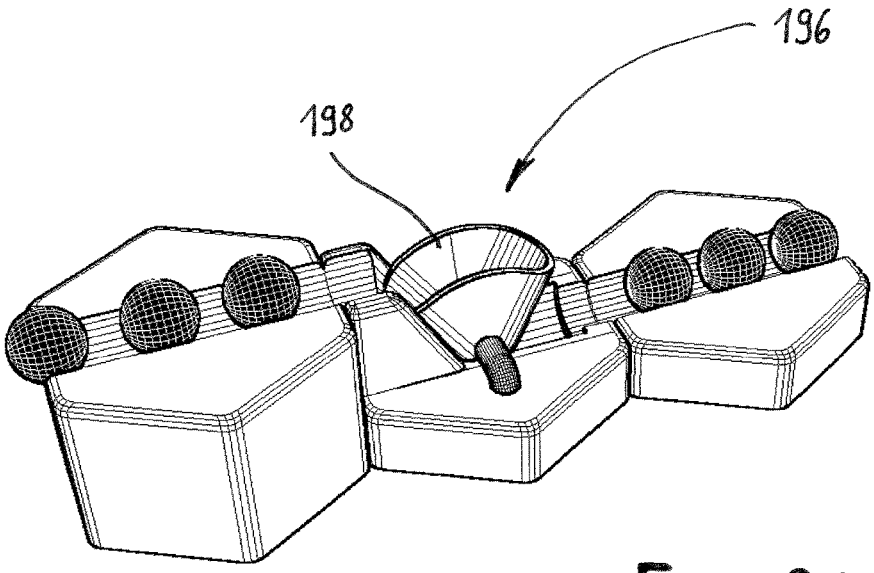
Figure 37:
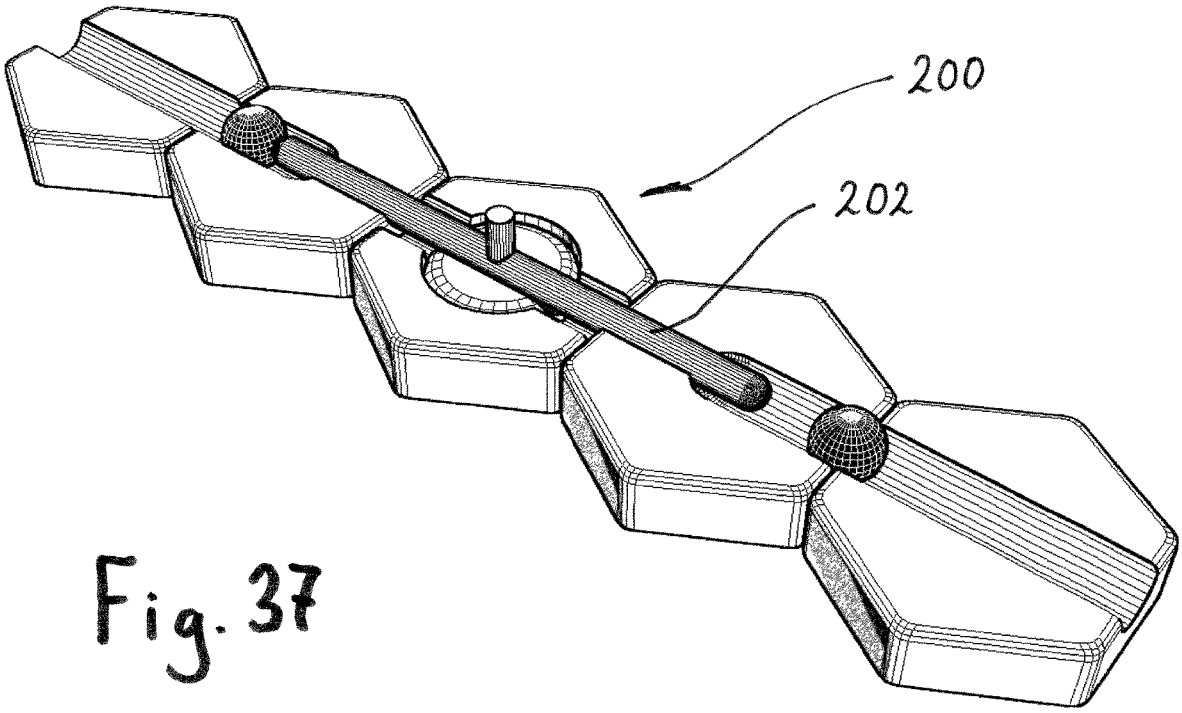
Figure 38:
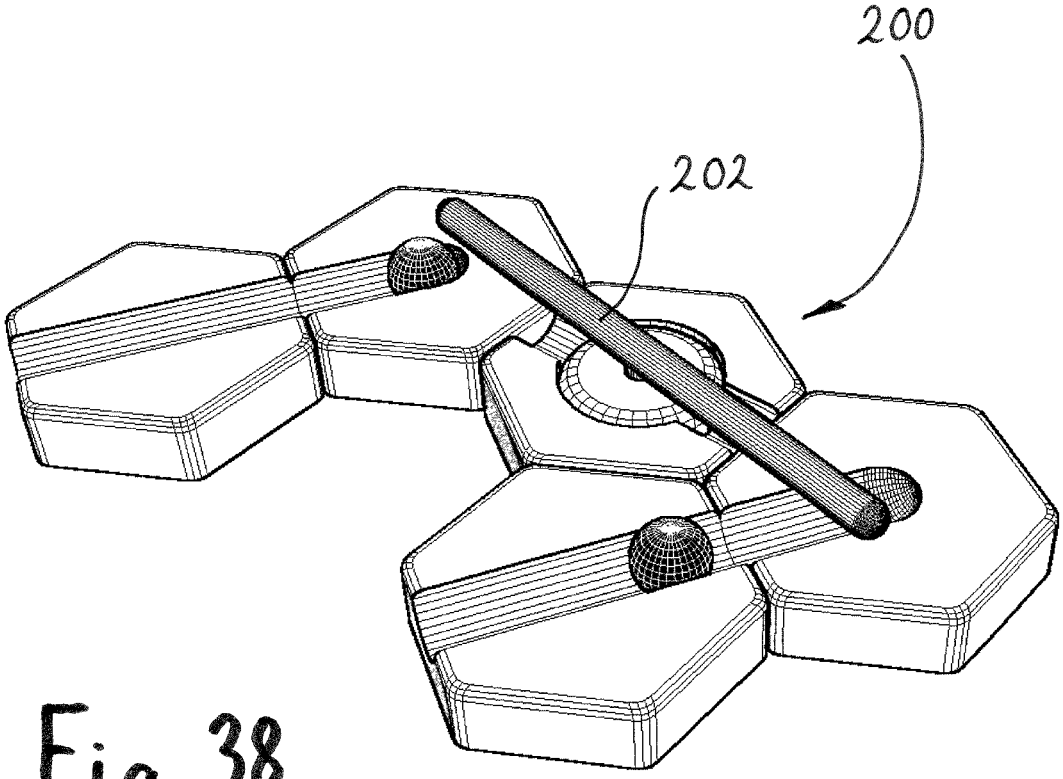

An exemplary embodiment of a modular ball track system according to the invention will be described in greater detail hereinbelow with reference to the accompanying schematic drawings, in which:

FIG. 1 is a spatial representation of an example of a module element of a ball track system according to the invention obliquely from above, FIG. 2 shows the module element of FIG. 1 in a side view, FIG. 3 shows the module element of FIG. 1 in a spatial representation obliquely from beneath, FIG. 4 shows a base plate of a ball track system according to the invention consisting of a plurality of base plate segments, FIG. 5 shows a base plate segment of FIG. 4 in an enlarged representation, FIG. 6 is a spatial representation of a connecting rail of a ball track system according to the invention for bridging a gap between module elements, FIG. 7 shows the upper end in FIG. 6 of the connecting rail in an enlarged representation, FIGS. 8*a* and 8*b* show the cooperation of the connecting rail of FIG. 6 with the module element of FIG. 1 in two different states, FIG. 9 shows a column element of a ball track according to the invention in a spatial representation obliquely from above, FIG. 10 shows the column element of FIG. 9 in longitudinal section, FIG. 11 shows an intermediate plate of a ball track system according to the invention in a spatial representation obliquely from above, FIG. 12 shows a module element having a central opening for receiving a functional insert in a spatial representation obliquely from above, FIGS. 13*a* to 13*d* show different functional inserts which can be inserted into the module element of FIG. 12, in a spatial representation obliquely from above, FIG. 14 shows another module element in a spatial representation obliquely from above, FIG. 15 shows yet another module element in conjunction with a finish rail in a spatial representation, FIG. 16 shows a module element having a points function in a plan view, FIG. 17 shows a module element having a vortex function in a spatial representation obliquely from above, FIG. 18 shows a module element having a start function in a spatial representation obliquely from above, FIG. 19 shows a module element having a Gauss cannon function in a spatial representation obliquely from above, FIG. 20 shows a module element having a ball-lift function in conjunction with two adjoining module elements, FIG. 21 shows a module element having a more pronounced ball-lift function in conjunction with two adjoining module elements, FIG. 22 shows a module element having a gate function in conjunction with three adjoining module elements, FIG. 23 shows a module having a sling or catapult function in conjunction with two adjoining module elements, FIG. 24 shows a module element having an acceleration function in conjunction with two adjoining module elements, FIG. 25 shows a module element for releasing a ball by means of another ball, FIG. 26 shows a module element having a firing function in conjunction with two adjoining module elements, FIG. 27 shows a module element having a three-way distribution function in conjunction with four adjoining module elements, FIG. 28 shows a module element having a bell function, FIG. 29 shows a module element having a crossover function in conjunction with two adjoining module elements, FIG. 30 shows a module element having a loop, FIG. 31 shows a module element having a bridge function, FIG. 32 shows a module element having a checkered flag function, FIG. 33 shows a module element having a splash function, FIG. 34 shows a module element having a "leg-up" function, FIG. 35 shows a module element having a cascade function, FIG. 36 shows a module element having a collect and transfer function, FIG. 37 shows a module element having an impulse function, and FIG. 38 shows the module element of FIG. 37 in a different arrangement.

FIGS. 1 to 3 are different views of an example of a module element 12 of a modular ball track system which comprises a plurality of such module elements, all of which have the exterior shape shown of a regular hexagon of equal size and each form on their upper face one or more ball track sections which can be combined with one another by putting the module elements together.

The example of a module element 12 shown in FIGS. 1 to 3, like all further module elements of the modular ball track system, has an upper face 14, a lower face 16 opposite the upper face, and six lateral surfaces 18. In the module element 12 shown, two ball track sections 20 and 22 are formed on the upper face 14, which ball track sections have a cross-section having the shape of a segment of a circle and are let into the surface 14 of the module element 12. A first ball track section 20 begins in the left lateral surface 18 in FIG. 1 of the module element 12 and extends in curved form to the immediately adjoining top lateral surface 18 in FIG. 1 of the module element 12, the first ball track section 20 passing through each of the two lateral surfaces 18 so that the ball track can be continued by adding further module elements. A second ball track section 22 begins in a left, lower lateral surface 18 of the module element 12 shown in FIG. 1 and runs with a less pronounced curve to a next-but-one, right lateral surface 18 in FIG. 1 of the module element 12. It will be appreciated that the beginning and the end of the ball track sections 20, 22 merely depend on the direction in which a ball runs through the corresponding ball track section. The beginning of a ball track section can therefore at the same time be the end of the ball track section, depending on the direction in which the ball runs through the ball track section.

As can be seen particularly clearly in FIGS. 1 and 2, the example of a module element 12 and all further module elements of the modular ball track system are disk-shaped overall, that is to say the height of the lateral surfaces 18 extending at least approximately at right angles to the upper face 14 is significantly smaller than the dimensions of the module element 12 in the other two spatial directions of a Cartesian coordinate system.

As can best be seen in FIGS. 2 and 3, a plug base 24 protrudes from the lower face 16 of the example of a module element 12 and also from all further module elements of the modular ball track system, which plug base in the exemplary embodiment shown likewise has the form of a regular hexagon, the sides of which are parallel to the lateral surfaces 18 of the hexagon forming the exterior shape of the module element 12. As can be seen in FIG. 3, the example of a module element 12 is a part produced by a plastics injection molding process, for which reason the lower face 16 is for the most part open. In order to increase the stability of such a module element 12, reinforcing ribs 26 extend between outside walls 28 forming the lateral surfaces 18 and inner walls 30 forming the plug base 24.

The modular ball track system further includes a base plate 32 shown in FIGS. 4 and 5 having a plurality of regularly arranged, here hexagonal recesses 34, each of which serves to receive one plug base 24. The recesses 34 are arranged on the base plate 32 in a grid which here is honeycomb-shaped, the grid dimension s of the grid corresponding to the incircle diameter of the regular hexagon forming the exterior shape of the module elements, that is to say the diameter of the largest circle which can be inscribed in the hexagon forming the exterior shape of the module elements.

By means of the plug base 24, module elements such as the example of a module element 12 can thus be fitted into recesses 34 of the base plate 32, module elements fitted into recesses 34 of the base plate 32 that are immediately adjacent to one is another lying flush against one another with in each case one of their lateral surfaces 18 so that a ball track section formed on a module element can merge into a ball track section formed on an adjoining module element in an almost transition-free manner. As can readily be understood from considering FIGS. 3 and 5 together, the incircle diameter d of each recess 34 is smaller than the incircle diameter, corresponding to the grid dimension s, of the hexagon forming the exterior shape of a module element.

The base plate 32 shown in FIG. 4 is composed of a plurality of base plate segments 36, one of which is shown in an enlarged representation in FIG. 5. For the interlocking connection of the base plate segments 36 in the base plate plane, each base plate segment 36 is provided at its edges with here dovetail-shaped projections 38 and dovetail-shaped cutouts 40, by means of which the individual base plate segments 36 can be hooked together. The form of the projections 38 and cutouts 40 shown is merely by way of example. In other forms of base plate segments which are not shown, the projections and cutouts can have a different shape, and both projections and cutouts can be present on an edge of a base plate segment. Furthermore, the base plate segments 36 of the exemplary embodiment shown here are made of a stable cardboard, as is used, for example, in the production of conventional jigsaws, but the base plate segments can also be made of a different material, for example of plastics material, a metal or of wood.

It should have become clear from the above description that module elements such as the example of a module element 12 can be combined on the base plate 32 to form a ball track by placing the individual module elements next to one another on the base plate 32 according to a desired run of the ball track. However, the module elements do not necessarily have to be arranged immediately next to one another on the base plate 32, since the modular ball track system according to the present invention further comprises connecting rails 42, which are shown in FIGS. 6 and 7. Although only one connecting rail 42 of a predetermined length is shown in FIG. 6, the modular ball track system can also comprise connecting rails of a different length, for example connecting rails of three different lengths, the lengths of which have a ratio to one another of 1:2:3, that is to say the longest connecting rail is three times as long as the shortest connecting rail.

The connecting rail 42 is formed substantially of two rods 44, here having a circular cylindrical cross-section, which are arranged parallel to one another and form a section of the ball track, the rods 44 being connected to one another to form a ladder-like structure by a plurality of cross-members 46 (here three) which extend beneath the ball track transversely to the rods 44. Each rod 44 has two free ends 48 which are bent downwards in the manner of a hook. By means of these hook-like ends 48, the connecting rail 42 can be hooked into a pair of hooking openings 50 which are formed in the example of a module element 12 (and also in every other module element) at the end or beginning of each ball track section formed on a module element (see FIG. 1). More precisely, the hooking openings 50 are let into the ball track on both sides of the ball track immediately adjacent to the point at which a ball track section passes through a lateral surface 18 of the module element 12.

The cooperation of the free ends 48, bent downwards in the manner of a hook, of a connecting rail 42 with the hooking openings 50 of a module element 12 is shown in greater detail in FIGS. 8*a* and 8*b*. FIG. 8*a* shows a configuration in which the connecting rail 42 connects a module element 12 to a further module element (not shown) situated in the same plane, while FIG. 8*b* shows a configuration in which the connecting rail 42 connects a module element 12 at a higher level to a module element at a lower level (not shown). The two configurations shown in FIGS. 8*a* and 8*b* are possible despite a constant length of the connecting rail 42 because the hooking openings 50 allow the free ends 48 of the connecting rail 42 a predetermined degree x of freedom of movement in the longitudinal direction of the connecting rail 42 and thus in the longitudinal direction of the ball track.

Connecting rails 42 thus serve to bridge a gap between two module elements which are not arranged immediately adjacent to one another, which can be either at the same level or at different levels. In order to reduce the risk that a ball moving along the ball track will fall out of the ball track as it moves from a module element to a connecting rail or vice versa, each cross-member 46 arranged close to the free ends 48 of the rods 44 is lengthened and raised up at the sides in order thus to form guards 52 on both sides of the ball track close to the transition from a connecting rail 42 to a module element, on which guards a ball can be supported if necessary (see FIG. 7). In order to make the transition between a connecting rail 42 and a module element as jolt-free as possible for a ball rolling on the ball track, each rod 44 is further provided on its upper side with a ramp-like elevation 54 in a region close to each free end, which elevation lifts a ball rolling on the connecting rail 42 slightly shortly before it passes over onto a module element. In the form shown, the connecting rails 42 can advantageously be produced as injection-molded plastics parts.

That the module elements of the modular ball track system do not all have to be in the same plane has already been touched upon. In order to be able to arrange module elements such as the example of a module element 12 at different heights, the ball track system comprises column elements, of which a column element 56 is shown in FIGS. 9 and 10. In conformity with the module elements, the column elements 56 have the exterior shape of a regular hexagon with a slightly smaller incircle diameter compared with the module elements. In order that the column elements 56 can be freely combined with module elements and the base plate 32, each column element 56 has on its upper face a recess 34', the arrangement and dimensions of which correspond to a recess 34 of the base plate 32. The plug base 24 of a module element 12 thus fits into this recess 34'. Each column element 56 further has on its lower face a plug base 24', which corresponds in shape, arrangement and dimensions to the plug base 24 of the module element 12. By using one or more column elements 56 stacked one above the other and then fitting a module element 12 to the uppermost column element 56, module elements can thus be arranged at many different heights. For finer height gradation, the ball track system can contain column elements of different heights, for example column elements whose height h is only half that of the column element 56 shown in FIGS. 9 and 10.

By means of the above-described column elements 56, larger regions of the ball track according to the invention can also be arranged at a higher level than the base plate 32. There is used for this purpose an intermediate plate 58 shown in FIG. 11 which, like the base plate 32, has a plurality of regularly arranged, hexagonal recesses 34" for receiving in each case one plug base 24, 24'. The recesses 34" of the intermediate plate 58 are arranged in the same honeycomb-shaped grid as the recesses 34 of the base plate 32 and have the same grid dimension s. On the lower face of each recess 34" of the intermediate plate 58 there is formed a plug base 24" which fits, for example, into the recess 34' of a column element 56. By supporting an intermediate plate 58 on the base plate 32 by means of a plurality of columns each constructed from column elements 56, it is possible to produce intermediate levels of the ball track, which make the run of the ball track more interesting and more exciting. In order to make regions of the ball track located beneath an intermediate plate 58 visible, the intermediate plate 58 shown is advantageously made of transparent plastics material.

Different forms of the module elements of the modular ball track system according to the invention will be described in greater detail hereinbelow. FIG. 12 shows a module element 12' whose peripheral form and dimensions correspond to those of the module element 12 shown in FIG. 1 but which has a central opening 60 which here is in the form of a through-opening and communicates with a plurality of ball track sections 20' formed on the upper face 14 of the module element 12' and serves to receive a functional insert which is associated with at least one of the ball track sections 20'. FIGS. 13*a* to 13*d* show several examples of functional inserts.

FIG. 13*a* shows a functional insert 62 in the form of a tray, which can serve, for example, as a target which all the balls are to reach. The balls that reach the target then collect in the functional insert 62.

FIG. 13*b* shows a functional insert 62' in the form of a ramp, which can serve, for example, to catch balls from a higher level and transfer them through an outlet 64 to one of the ball track sections 20'. Alternatively, the functional insert 62' can serve as a starting point of a ball track.

FIG. 13*c* shows a functional insert 62" which receives a ball that arrives via a ball track section 20' of the module element 12' and guides it into the central through-opening 60 of the module element 12', so that this ball falls from a higher level into a level located beneath it.

Finally, FIG. 13*d* shows a functional insert 62"' which communicates with each of the three ball track sections 20' of the module element 12' and has three depressions 66, in each of which a ball (not shown) can be placed. If a further ball then falls centrally from above onto the functional insert 62"', for example using the above-described functional insert 62" in a module element 12' arranged in a plane located above, the three balls located in the depressions 66 "splash" in the direction of the three ball track sections 20' of the module element 12' thereof.

The above-described functional inserts 62, 62', 62" and 62"' are only by way of example. Many further functional inserts are possible. Also, the central opening 60 of the module element 12' does not necessarily have to be in the form of a through-opening but can instead have a bottom (not shown), if a ball is not required to fall down through it.

FIG. 14 shows a further module element 12", which differs from the module element 12 shown in FIG. 1 only in that the two ball track sections 20' and 22' formed on its upper face 14 cross.

FIG. 15 shows a module element 12"' which leads three ball track sections 20", 21 and 22" to a common outlet, at which a finish rail 68 similar to the connecting rail 42 of FIG. 6 is hooked. This finish rail 68 serves not to bridge a gap between two module elements but to receive balls which reach the target in succession. The finishing placings of the balls are obtained from the order in which the balls are received by the finish rail 68.

Module elements which contain an action element in addition to the at least one ball track section formed on their upper face will be described hereinbelow.

FIG. 16 shows, in plan view, a module element 70 having a points function. On the upper face 14 of the module element 70 there are formed two ball track sections 71, 72 which together have a Y-shaped form. A points element 74 is pivotably mounted on the upper face 14 of the module element 70 above the Y-shaped part of the ball track and has a long guide arm 76 pointing towards the foot of the Y and two short control arms 78 pointing towards the legs of the Y. In the position of the points element 74 shown in FIG. 16, an incoming ball at the foot of the Y is guided by the guide arm 76 of the points element 74 into the right-hand ball track section 72, where it strikes the right-hand control arm of the two control arms 78. The ball striking this control arm 78 in this manner serves to pivot the points element 74 counter-clockwise, so that the ball is able to roll further and the guide arm 76 now rests against the foot of the Y on the opposite side of the ball track, so that the next ball that rolls into the module element 70 at the foot of the Y is guided into the left-hand ball track section 71, whereupon the points element 74 pivots into the position shown in FIG. 16 again. Accordingly, the module element 70 guides balls that roll into the module element at the foot of the Y alternately into the ball track section 71 and the ball track section 72. The points element 74 can of course also be pivoted by hand, if desired.

FIG. 17 shows a module element 80 having a so-called vortex function. For this purpose, the module element 80 is provided with a region 82 in the form of a funnel, which has a central opening 84 at the bottom. Balls entering the module element 80 via the ball track sections 20' first move in a vortex line shape in the region 82 in the form of a funnel and then fall down out of the module element 80 through the central opening 84.

FIG. 18 shows a module element 86 having a start function for three balls. For this purpose, three ball receivers 88 are formed on the upper face of the module element 86 in a central region, in each of which receivers one ball (not shown) can be placed. A release component 90 which covers the balls and is spring-mounted normally to the upper face of the module element 86 prevents, in an upper position into which it is urged by the spring, the balls arranged in the ball receivers 88 from rolling out by in each case a barrier 92 which protrudes upwards from the associated ball track section 20'. By pressing down in the center of the release component 90 against the spring force, the barriers 92 are lowered to such an extent that balls located in the ball receivers 88 are at the same time able to roll free.

FIG. 19 shows a module element 94 having a so-called Gauss cannon function. In order to achieve this function, a ball track section 96 extending across the module element 94 is blocked by a disk-shaped magnet 98 which is arranged transversely to the ball track section 96 and is received in a bridge-shaped holder 100. One or two balls of magnetic material can be placed on both sides of the magnet 98, which balls are prevented from rolling away by the magnetic force. If a further ball then rolls into the ball track section 96 from one side and strikes the balls already located therein, a ball on the side of the magnet 98 remote from the impact is released by the impulse of the striking ball.

FIG. 20 shows a module element 102 having a ball-lift function. On the upper face 14 of the module element 102 there is formed a ball track section 104 having a ramp 106, the level of which is higher than the start of the ball track section 104. A lever 110 is pivotably mounted on a bridge-like holder 108 which spans the ball track section 104. The lever 110 is provided at its lower end in FIG. 20 with a release member 112, which has a short arm 113, which projects downwards in the position shown, and a long arm 114, which extends at a right angle thereto in the direction towards an incoming ball. To the opposite end of the lever 110 there is fixed a weight 116. In the starting position of the lever 110 shown in FIG. 20, the lever is in a so-called over-dead-center position, that is to say the weight 116 is located with its center of gravity slightly to the right of a plane normal to the upper face 14 of the module element 102 and running through the holder 108. A ball rolling into the module element 102 strikes the short arm 113 of the release member 112, whereby the lever 110 is pivoted counter-clockwise out of its over-dead-center position, so that the weight, which is now located to the left of the mentioned plane running through the holder 108, continues and accelerates the pivoting of the lever 110. The long arm 114 of the release member 112 contacts the ball and moves it up the ramp 106.

FIG. 21 shows a further module element 118 having a more pronounced ball-lift function. Similarly to the module element 102 described above, a lever 110' is pivotably mounted on a holder 108' and provided with a weight 116'. At its end opposite the weight 116', the lever 110' is provided with a cup 120 for receiving a ball. The free edge of the cup 120 abuts a spring-mounted release rail 122 mounted in the ball track section 20' and is thereby prevented from pivoting. A ball rolling into the ball track section 20' depresses the release rail 122 with its weight as it rolls into the cup 120, so that the lever 110' is able to pivot freely. The weight 116' pivots the lever 110' clockwise, whereby the ball in the cup 120 is conveyed to the elevated level of the ball track section 20'.

FIG. 22 shows a module element 124 having a gate function. For this purpose, an arcuate gate element 126 spans a ball track section 125 formed on the upper face 14 of the module element 124. In the position shown, the gate element 126 prevents a ball from passing to the part of the ball track section 125 situated on the other side of the gate element. Connected to the gate element 126 is a spoon-shaped release member 128, which is associated with a further ball track section 129 of the module element 124. Between the spoon-shaped release member 128 and the arcuate gate element 126, the gate formed of the above-mentioned two parts is pivotably mounted at 130. If a ball arrives at the spoon-shaped release member 128, it depresses it with its weight and at the same time raises the gate element 126, so that a ball that was initially held in the ball track section 125 is allowed free passage.

FIG. 23 shows a module element 132 having a sling or catapult function. The function of this module element 132 is similar to that of the module element 118 described with reference to FIG. 21, but the module element 132 has only a one-sided lever 110" having the cup 120. The lever 110" is biased for pivoting in the clockwise direction by means of a rubber band 134. As soon as a ball rolling into the cup 120 has depressed the release rail 122, the lever 110" pivots clockwise in a flash owing to the resilient bias of the rubber band 134 and catapults the ball in the cup 120 to the right.

FIG. 24 shows a module element 136 whose function is similar to that of the module element 102 described with reference to FIG. 20. Unlike the module element 102, however, an incoming ball is not lifted to a higher level by the release member 112' after overcoming the over-dead-center position of the lever 110'", but the hammer-like weight 116" strikes the ball from behind and accelerates it to the right in FIG. 24.

FIG. 25 shows a module element 138 having a ball release function by means of another ball. Similarly to the module element 102, a lever 140 is pivotably mounted, but this lever 140 has two arms 141, 142 arranged at right angles to one another. A first arm 141 is arranged above a launch ramp 143 of the module element 138 and has a circular opening, the diameter of which corresponds to the diameter of a ball that is used. As shown, a ball can in this manner be held at the upper end of the launch ramp 143 by the first arm 141. A second arm 142 of the lever 140, which second arm is directed perpendicularly downwards in FIG. 25, carries a release member 144. A ball rolling into the module element 138 strikes the release member 144, whereby the lever 140 pivots slightly in the counter-clockwise direction and thereby releases the ball held by the first arm 141.

FIG. 26 shows a module element 146 having a firing function for another ball. Arranged on the module element 146 is a firing device 148 having a spring-biased piston 150. To the left and right of the firing device 148 there are two release members 152 on the module element 146, which release members can be depressed by the weight of an incoming ball in order to release the biased piston 150. A ball situated in front of the piston 150 is then fired into the adjoining ball track section.

FIG. 27 shows a module element 154 having a three-way distribution function. Similarly to the module element 70 described with reference to FIG. 16, the module element 154 also has ball track sections with a generally Y-shaped profile. However, the ball track section formed by the foot of the Y additionally extends over the entire module element 154, so that a ball rolling into the foot of the Y can be conveyed in three different directions. This is effected by means of two points elements 156, 157 arranged on the right and left of the central ball track, each of which points elements has a long guide arm 158, 158' and a short control arm 159, 159', which as shown are arranged at an angle to one another. The pivotable points elements 156, 157 are shown in FIG. 27 in a position which occurs when a first ball has already left the module element 154 through the ball track outlet located at bottom right. The next ball is then, as shown, guided into the ball track outlet of the module element 154 located at top left and then positions the points element 156 in a position that frees the central passage.

FIG. 28 shows a module element 160 having a bell function. For this purpose, a bell 162 is so arranged on the module element 160 that the edge of the bell cap projects into a ball track section 162 which is formed on the upper face 14 of the module element 160. A ball passing through the ball track section 162 strikes the bell 162, so that a bell sound sounds.

FIG. 29 shows a module element 164 having a crossover function. For this purpose there is formed on the module element 164 a ball track section 165 which extends in the form of a circular ring and communicates with two outlets 166, 167. A ball entering the circular ball track section 165 through one outlet 166 is thus guided in a circle and leaves the module element 164 through the other outlet 167.

FIG. 30 shows a module element 168 on which there is formed a ball track section 170 in the form of a loop.

FIG. 31 shows a module element 172 having a bridge function. For this purpose, the module element 172 is provided on its upper face 14 with a ball track section 173 extending in a straight line over the entire module element, and further has a ball track section 174 which crosses the ball track section 173 in the manner of a bridge.

FIG. 32 shows a module element 176 having a checkered flag function. For this purpose, a checkered flag 178 which spans the module element 176 in the manner of a bridge is pivotably mounted on both sides of a target funnel 179, at the deepest point of which there is a release member 180. If a ball rolls into the target funnel 179, it depresses the release member 180 with its weight, whereby the pivotably mounted checkered flag 178 is pivoted upwards out of its position shown in FIG. 32 in order to indicate that a ball has reached the target.

FIG. 33 shows a module element 182 having a so-called splash function. The function of this module element 182 corresponds to the function of the functional insert 62''' described with reference to FIG. 13*d*.

FIG. 34 shows a module element 184 having a so-called "leg-up" function. On the module element 184 there is formed a first ball track section 185 which ends beneath a ball track section 186 which spans the ball track section 185 in the manner of a bridge. In the bridge-like ball track section 186, exactly above the ball track section 185, there is a circular hole 187 in which a ball that crosses the bridge-like ball track section 186 normally gets caught. If, however, there is a ball at the end of the ball track section 185, this ball fills the hole 187 to such an extent that a ball crossing the bridge-like ball track section 186 is able to roll further. Alternatively, a ball rolling into the ball track section 185 has the effect, when a ball is already in the hole 187, that this ball is "freed" by the ball rolling into the ball track section 185 and is able to roll further.

FIG. 35 shows a module element 188 having a so-called cascade function. In order to achieve this function, there is fastened to the module element 188 a funnel 190 having a mouth 192 which leads to an outlet of the module element 188. Two inlets of the module element 188 are each provided with a release member 194 which can be depressed by the weight of an incoming ball. A gate (not shown) arranged in the mouth 192 is unlocked by the depression of the release member 194, so that all the balls in the funnel 190 fall downwards and roll through the mouth 192 into the adjoining ball track.

FIG. 36 shows a module element 196 having a collect and transfer function. For this purpose, the module element 196 is provided with a pivotably and eccentrically mounted cup 198 into which balls from a higher level of the ball track are able to fall from the left in FIG. 36. As soon as a specific number of balls, for example three balls, have fallen into the cup 198, the cup 198 overcomes its dead-center position and tips to the other side, so that the balls collected therein are released into the adjoining ball track section situated at a lower level.

FIG. 37 shows a module element having an impulse function. For this purpose, a rod 202 which extends longitudinally is arranged on the module element 200, which rod projects beyond the module element 200 in both directions and reaches into adjoining ball track sections. If one end of the rod 202 is struck by a ball, the impulse thereof travels through the rod 202 to the opposite end thereof and can be transmitted to a ball that is in contact with the opposite end.

FIG. 38 shows the module element of FIG. 37 in a modified configuration. An impulse is again transmitted from one ball to another ball through the rod 202, but this impulse transfer is achieved according to FIG. 38 by a rotation of the rod 201

The invention claimed is:

1. A modular ball track system, comprising a plurality of module elements, all of which, in plan view, have an exterior shape of a common regular hexagon, and each of which has an upper face, a lower face opposite the upper face, and a number of lateral surfaces corresponding to a number of corners of the regular hexagon forming the exterior shape thereof, at least one section of a ball track formed on the upper face of each of the plurality of module elements and passing through one of the number of lateral surfaces of the module element, and wherein the lower face of each module element has a plug base protruding therefrom or a recess for receiving a plug base, and a base plate having, in the case of a plug base protruding from the lower face of each module element, a plurality of regularly arranged recesses for receiving, in each case, a respective one of the plug bases or, in the case of the lower face of each module element having a recess, a plurality of regularly arranged plug bases for cooperating with, in each case, a respective one of the recesses, wherein the plurality of recesses or plug bases are arranged on the base plate in a grid having grid dimensions corresponding to an incircle diameter of the regular hexagon forming the exterior shape of the module elements, and wherein module elements fitted into the recesses, or the plug bases, of the base plate that are located immediately adjacent to one another have, in each case, respective ones of the number of lateral surfaces of each lying flush against one another.

2. The ball track system as claimed in claim 1, wherein each plug base or recess is configured to allow two of the module elements arranged adjacent to one another to be fitted into or onto the base plate only in a position in which the module elements have, in each case, respective ones of the number of lateral surfaces of each lying flush against one another.

3. The ball track system as claimed in claim 2, wherein each plug base or recess has the same shape as the regular hexagon forming the exterior shape of the module elements, but with a smaller incircle diameter than the incircle diameter of the regular hexagon forming the exterior shape of the module elements.

4. The ball track system as claimed in claim 1, further comprising connecting rails each forming a section of the ball track for bridging a gap defined between two respective module elements which are not arranged immediately adjacent to one another.

5. The ball track system as claimed in claim 4, wherein each connecting rail has two rods arranged parallel to one another to form the respective section of the ball track, wherein the two rods are fixed to one another by a plurality of cross-members extending beneath the ball track transversely to the two rods, and wherein the two rods each have free ends.

6. The ball track system as claimed in claim 5, wherein the free ends of the rods are bent downwards to form a hook.

7. The ball track system as claimed in claim 5, wherein each cross-member is arranged close to each of the free ends of the respective two rods and is extended upwards alongside each of the two rods to form guards.

8. The ball track system as claimed in claim 5, wherein each of the two rods is provided close to the free ends thereof and on an upper side thereof with a ramp like.

9. The ball track system as claimed in claim 1, wherein each module element, immediately adjacent to where, or each point at which, the at least one section of the ball track formed on the upper face of the module element passes through one of the lateral surfaces of the module element, has a pair of hooking openings for connecting rails let into the ball track on both sides of the ball track.

10. The ball track system as claimed in claim 9, further comprising connecting rails, wherein the hooking openings are configured to receive rods of the connecting rails.

11. The ball track system as claimed in claim 9, wherein the hooking openings are configured to allow the connecting rails a predetermined degree of movement in a longitudinal direction of the ball track.

12. The ball track system as claimed in claim 1, further comprising column elements of a predetermined height, wherein:

in the case of a plug base protruding from the lower face of each module element, each column element has on a lower face thereof another plug base corresponding to the plug base protruding from the lower face of each module element, and has on an upper face thereof another recess corresponding to one of the recesses in the base plate for receiving the plug base protruding from the lower face of one of the module elements, or, in the case of the lower face of each module element having a recess, each column element has on a lower face thereof another recess corresponding to the recess in the lower face of each module element, and has on an upper face thereof another plug base corresponding to one of the plug bases of the base plate.

13. The ball track system as claimed in claim 1, further comprising at least one intermediate plate, wherein:

in the case of a plug base protruding from the lower face of each module element, the at least one intermediate plate has a plurality of regularly arranged recesses each corresponding in shape and arrangement to the recesses of the base plate, and each for receiving the plug base protruding from the lower face of one of the module elements, wherein each recess of the intermediate plate has a lower face defining another plug base corresponding to the plug base protruding from the lower face of each module element, or, in the case of the lower face of each module element having a recess, the at least one intermediate plate has a plurality of regularly arranged plug bases each corresponding in shape and arrangement to the plug bases of the base plate, and each for cooperating with the recess in the lower face of one of the module elements, wherein each plug base of the intermediate plate has a lower face defining another recess corresponding to the recess in the lower face of each module element.

14. The ball track system as claimed in of claim 1, wherein the base plate is formed of a plurality of base plate segments configured to be hooked together in a plane of the base plate.

15. The ball track system as claimed in claim 1, wherein the at least one section of the ball track formed on the upper face of each module element comprises a first curved section and a second curved section, wherein the first section has a more pronounced curve than the second section.

16. The ball track system as claimed in claim 1, wherein at least one of the plurality of module elements has a central opening which communicates with the at least one section of the ball track formed on the upper face of the module element and is configured to receive a functional insert associated with the at least one section of the ball track.

17. The ball track system as claimed in claim 1, wherein the at least one section of the ball track contains an action element in the form of points, a loop, a ball lifter, a Gauss cannon, a catapult, or a funnel.

18. The ball track system as claimed in claim 1, further comprising balls having at least one of the same size but a different weight and different magnetic properties.

19. The ball track system as claimed in claim 1, further comprising balls having an integrated RFID chip.

20. The ball track system as claimed in claim 1, wherein:

in the case of a plug base protruding from the lower face of each module element, the regular arrangement of the plurality of recesses in the base plate corresponds to a honeycomb structure, or, in the case of the lower face of each module element having a recess, the plurality of regularly arranged plug bases of the base plate corresponds to a honeycomb structure.

* * * * *